United States Patent [19]

Wright

[11] Patent Number: 4,974,770

[45] Date of Patent: Dec. 4, 1990

[54] CUSTOMIZED PACKAGING

[75] Inventor: Robert C. Wright, Loveland, Colo.

[73] Assignee: Eastman Kodak Company, Rochester, N.Y.

[21] Appl. No.: 490,516

[22] Filed: Mar. 1, 1990

Related U.S. Application Data

[63] Continuation-in-part of Ser. No. 449,639, Dec. 12, 1989.

[51] Int. Cl.[5] ..... B65D 81/02; B65D 5/32

[52] U.S. Cl. ..... 229/23 AB; 206/594; 229/23 A; 229/40

[58] Field of Search ..... 206/521, 594; 229/23 A, 229/23 AB, 40, 87 R, 23 R

[56] References Cited

U.S. PATENT DOCUMENTS

| | | | |
|---|---|---|---|
| 987,958 | 3/1911 | Clenny et al. | 229/23 |
| 1,399,305 | 12/1921 | Molnar | 229/23 |
| 2,246,097 | 6/1941 | Illges | 229/23 A |
| 2,276,128 | 3/1942 | Wellman | 229/23 |
| 2,314,951 | 3/1943 | Ringler | 229/23 |
| 2,387,482 | 10/1945 | Vineberg | 229/23 |
| 2,703,645 | 3/1955 | Scrimshaw | 229/40 |
| 3,024,939 | 3/1962 | Kantor | 229/23 |
| 3,057,468 | 10/1962 | Allan, Jr. | 206/594 |
| 3,145,905 | 8/1964 | Moore | 229/23 |
| 3,170,617 | 2/1965 | Vineberg | 229/23 |
| 3,227,354 | 1/1966 | Gunyou | 229/23 |
| 3,279,677 | 10/1966 | Wojcik | 206/594 |
| 3,281,049 | 10/1966 | Avitable et al. | 229/23 |
| 3,295,741 | 1/1967 | Meyers | 229/40 |
| 3,445,051 | 5/1969 | Goldman | 229/23 |
| 3,666,166 | 5/1972 | Freakes | 229/23 |
| 3,718,275 | 2/1973 | Willinger | 206/594 |
| 3,744,700 | 7/1973 | Stegmann | 229/23 |
| 3,952,672 | 4/1976 | Gordon et al. | 229/23 AB |
| 3,966,113 | 6/1976 | Tipton | 229/40 |
| 4,046,311 | 9/1977 | Voytko | 229/40 |
| 4,300,679 | 11/1981 | Benzschawel et al. | 229/40 |
| 4,589,552 | 5/1986 | Chevalier | 229/87 |
| 4,880,141 | 11/1989 | Gossler et al. | 229/23 A |

FOREIGN PATENT DOCUMENTS

| | | | |
|---|---|---|---|
| 79150 | 2/1968 | Brazil | 229/23 A |
| 1197378 | 7/1965 | Fed. Rep. of Germany | 229/23 A |
| 1074385 | 1/1960 | German Democratic Rep. | 229/23 AB |
| 373092 | 8/1939 | Italy | 229/23 AB |
| WO832764 | 8/1983 | PCT Int'l Appl. | 229/40 |
| 6423 | of 1888 | United Kingdom | 229/40 |
| 131928 | of 1919 | United Kingdom | 229/40 |

*Primary Examiner*—Gary E. Elkins
*Attorney, Agent, or Firm*—William C. Dixon, III

[57] ABSTRACT

A customized packaging arrangement, for securely containing rectanguloid articles that vary in size and aspect ratio, comprises a combination of inner and outer packages. The inner package consists of first and second rectangular paperboard sheets that are joined in superposed, transverse relation at their central portions to provide a rectangular double-walled bottom for supporting an article thereon, the two sheets extending perpendicularly therefrom to provide opposite side and end portions, which are first folded against the article sides and ends, respectively, and are then folded and joined in overlapping relation upon the article top. The inner package so formed is then centered on, and secured to, a third paperboard sheet, which includes a rectangular central portion that is larger than the inner-package bottom centered thereon and, extending perpendicularly therefrom, opposite side and end portions which are first folded upwardly into spaced, confronting relation with the inner-package sides and ends, respectively, and are then folded inwardly and joined in overlapping relation upon the inner-package top. The outer package so formed is spaced from the inner package around its sides and ends to provide cushioning against impact. All cutting and scoring of the three sheets thus forming the inner and outer packages may be automated on-line in accordance with given dimensions of the article(s) to be packaged.

20 Claims, 9 Drawing Sheets

CUSTOMIZED PACKAGING

CROSS-REFERENCE TO RELATED APPLICATION

This is a Continuation-in-Part of commonly assigned, copending U.S. patent application Ser. No. 449,639, filed Dec. 12, 1989 in the name of Robert C. Wright and titled CUSTOMIZED PACKAGING.

BACKGROUND OF THE INVENTION

1. Field of the Invention

The present invention relates generally to packaging, and particularly to a customized packaging arrangement for securely containing rectanguloid articles that vary in size and aspect ratio.

2. Description of the Prior Art

Packaging arrangements for securely containing rectanguloid articles are well known in the prior art. Examples may be found in the following documents:

U.S. Pat. No. 3,227,354 - Discloses a shipping container comprising two corrugated rectangular sheets that are disposed in orthogonal confronting relationship with their medial portions conforming to, and facing, respectively, the top and bottom surfaces of a rectanguloid article to be shipped, each sheet being creased and folded along four parallel lines to provide oppositely extending lateral and flap portions, the first such sheet having its medial portion covering the top surface of the article, its lateral portions covering the two opposite sides of the article, and its flap portions overlapping side marginal areas of the second sheet's medial portion, the second sheet's medial portion covering the bottom surface of the article, its lateral portions covering the two opposite, ends of the article, and its flap portions overlapping end marginal areas of the first sheet's medial portion, whereby all six faces of the article are covered by the two sheets.

U.S. Pat. No. 3,281,049 - Discloses a rectanguloid shipping container comprising two rectangular blanks of corrugated paperboard that are disposed in crossed, superposed relation, thereby providing a double-walled bottom, then folded upwardly to form the four container sides, and then folded inwardly in overlapping, abutting relation to provide a double-walled top, the inwardly folded top ends of the lower (outer) blank being folded over (thus outside) the inwardly folded top ends of the upper (inner) blank, the inwardly folded top ends of each of the blanks abutting each other to provide a complete wall (comprising two half-sections) across the container top.

U.S. Pat. No. 3,445,051 - Discloses a rectanguloid shipping container comprising two rectangular corrugated sheets superposed in crossed relationship and glued together at their overlapping medial portions to form a double-walled container bottom, the outward-projecting end portions of each sheet being first folded upwardly to form opposing container side walls and then folded inwardly to form abutting half-sections of a container top wall, the two sheets so folded thus providing a double-walled container top, the underlying (outer) sheet at the bottom being the overlying (outer) sheet at the top so as to constitute the outer wall at each of the double-walled bottom and top, and the overlying (inner) sheet at the bottom being the underlying (inner) sheet at the top so as to constitute the inner wall at the top and bottom.

U.S. Pat. No. 3,666,166 - Discloses a rectanguloid shipping container which is similar to that in U.S. Pat. No. 3,445,051, above, but differs therefrom in that (1) the end portions of the inner sheet that, when folded inwardly, form the inner wall at the top are less than half-sections, and therefore do not abut each other but instead are spaced apart, and (2) the outer sheet, which, when folded both upwardly and inwardly, completely surrounds the folded inner sheet, is wider than the distance between the opposing side walls formed by the folded inner sheet, thereby leaving a marginal void along each of those two opposing sides to provide buffering protection against impact.

While such prior-art arrangements as those described above may have sufficed for their own particular purposes, there nonetheless has remained a need for an improved packaging arrangement that is readily adaptable to automated on-line sizing and fabrication of customized, highly protective packaging for rectanguloid articles that may vary, randomly, in both size and aspect ratio.

An overall objective of this invention, therefore, has been to provide a customized packaging arrangement that meets the foregoing need, and to do so in an efficient, cost-effective, and reliable manner.

SUMMARY OF THE INVENTION

The present invention finds utility in an improved packaging arrangement for securely containing a rectanguloid article of given length, width, and height which define opposite sides, opposite ends, and opposite bottom and top surfaces of the article. Such an arrangement as improved by this invention comprises, generally, first and second paperboard sheets that are cut and scored according to article dimensions, brought together in crossed relation, and then folded in complementary fashion about the article to form a close-fitting inner package, around which a larger, pre-cut and scored third sheet is folded and secured to provide a protective outer package with enclosed spacing around the inner package to cushion the article against any potentially damaging impact.

According to one embodiment of this invention as illustrated the three sheets thus forming such inner and outer packages in this arrangement may be described as follows:

The first sheet is a substantially rectangular sheet of corrugated paperboard having a first-sheet width substantially equal to the article length and a first-sheet length that is greater than the article width plus twice the article height but not greater than twice the article width plus twice the article height. The first-sheet has transversely oriented, longitudinally spaced pairs of parallel inner and outer scored lines thereon defining a first-sheet rectangular central portion substantially conforming to the article bottom surface, a pair of first-sheet rectangular side portions extending respectively from opposite sides of the first-sheet central portion and substantially conforming to the article sides, and a pair of first-sheet flap portions extending respectively from the first-sheet side portions. The first-sheet central portion is adapted to support the article bottom surface thereon, the pairs of first-sheet side and flap portions then being folded about the pairs of first-sheet inner and outer scored lines, respectively, into adjacent confronting relation with the article sides and article top surface, respectively, when the article is supported on the first-sheet central portion.

The second sheet is a substantially rectangular sheet of corrugated paperboard having a second-sheet width substantially equal to the article width and a second-sheet length that is greater than the article length plus twice the article height but not greater than twice the article length plus twice the article height. The second-sheet has transversely oriented, longitudinally spaced pairs of parallel inner and outer scored lines thereon defining a second-sheet rectangular central portion substantially conforming to the first-sheet central portion, a pair of second-sheet rectangular end portions extending respectively from opposite ends of the second sheet central portion and substantially conforming to the article ends, and a pair of second sheet flap portions extending respectively from the second-sheet end portions. The second-sheet underlies the first-sheet transversely thereto so that the second-sheet central portion is in registered supporting relation with the first-sheet central portion, the pairs of second-sheet end and flap portions then being folded about the pairs of second-sheet inner and outer scored lines, respectively, into adjacent confronting relation with the article ends and article top surface, respectively, when the article is supported on the first-sheet central portion.

The third sheet is a sheet of corrugated paperboard that includes a third-sheet rectangular central portion having opposite sides and opposite ends of predetermined length and width, respectively, which are greater than the article length and width, respectively, whereby the third-sheet central portion is larger in area than the first-sheet and second-sheet central portions. The third-sheet central portion sides are defined by an inner pair of longitudinal scored lines equal in length to said predetermined length and separated by said predetermined width, while the third-sheet central portion ends are defined by an inner pair of transverse scored lines equal in length to said predetermined width and separated by said predetermined length. The third-sheet further includes a pair of third-sheet side portions, which extend laterally from the third-sheet central portion sides, respectively, to an outer pair of longitudinal scored lines equal in length to said predetermined length and spaced from the inner pair of longitudinal scored lines by at least the article height, and a pair of third-sheet side-flap portions, which extend laterally from the third-sheet side portions, respectively, to longitudinal edges thereof substantially equal in length to said predetermined length and spaced from the outer pair of longitudinal scored lines by substantially one-half said predetermined width. The third-sheet further includes a pair of third-sheet end portions, which extend longitudinally from the third-sheet central portion ends, respectively, to an outer pair of transverse scored lines equal in length to said predetermined width and spaced from the inner pair of transverse scored lines by at least the article height, and a pair of third-sheet end-flap portions, which extend longitudinally from the third-sheet end portions, respectively, to transverse edges thereof substantially equal in length to said predetermined width and spaced from the outer pair of transverse scored lines by at most one-half said predetermined length. The third-sheet underlies the second-sheet so that the second-sheet central portion is longitudinally aligned with and centrally disposed on the third-sheet central portion, the pairs of third-sheet side and end portions then being folded about the inner pairs of longitudinal and transverse scored lines, respectively, into spaced confronting relation with the folded pairs of first-sheet side portions and second-sheet end portions, respectively, whereupon the pairs of third-sheet side-flap and end-flap portions are folded about the outer pairs of longitudinal and transverse scored lines, respectively, into adjacent confronting relation with the folded pairs of first-sheet and second sheet flap portions.

According to another embodiment of this invention as illustrated herein, the three sheets forming the inner and outer packages of the claimed packaging arrangement may be described similarly as follows:

The first-sheet is a substantially rectangular sheet of corrugated paperboard having a first-sheet width substantially equal to the article width and a first-sheet length that is greater than the article length plus twice the article height but not greater than twice the article length plus twice the article height. The first-sheet has transversely oriented, longitudinally spaced pairs of parallel inner and outer scored lines thereon defining a first-sheet rectangular central portion substantially conforming to the article bottom surface, a pair of first-sheet rectangular end portions extending respectively from opposite ends of the first-sheet central portion and substantially conforming to the article ends, and a pair of first-sheet flap portions extending respectively from the first-sheet end portions. The first-sheet central portion is adapted to support the article bottom surface thereon, the pairs of first-sheet end and flap portions then being folded about the pairs of first-sheet inner and outer scored lines, respectively, into adjacent confronting relation with the article ends and article top surface, respectively, when the article is supported on the first-sheet central portion.

The second-sheet is a substantially rectangular sheet of corrugated paperboard having a second-sheet width substantially equal to the article length and a second-sheet length that is greater than the article width plus twice the article height but not greater than twice the article width plus twice the article height. The second-sheet has transversely oriented, longitudinally spaced pairs o f parallel inner and outer scored lines thereon defining a second-sheet rectangular central portion substantially conforming to the first-sheet central portion, a pair of second-sheet rectangular side portions extending respectively from opposite sides of the second-sheet central portion and substantially conforming to the article sides, and a pair of second-sheet flap portions extending respectively from the second-sheet side portions. The second sheet underlies the first-sheet transversely thereto so that the second-sheet central portion is in registered supporting relation with the first-sheet central portion, the pairs of second-sheet side and flap portions then being folded about the pairs of second-sheet inner and outer scored lines, respectively, into adjacent confronting relation with the article sides and article top surface, respectively, when the article is supported on the first-sheet central portion.

The third-sheet is a sheet of corrugated paperboard that includes a third-sheet rectangular central portion having opposite sides and opposite ends of predetermined length and width, respectively, which are greater than the article length and width, respectively, whereby the third-sheet central portion in larger in area than the first-sheet and second-sheet central portions. The third-sheet central portion sides are defined by an inner pair of longitudinal scored lines equal in length to said predetermined length and separated by said predetermined width, while the third-sheet central portion ends are defined by an inner pair of transverse scored lines equal in length to said predetermined width and separated by said predetermined length. The third-sheet further includes a pair of third-sheet side portions, which extend laterally from the third-sheet central portion sides, respectively, to an outer pair of longitudinal scored lines equal in length to said predetermined length and spaced from the inner pair of longitudinal scored lines by at least the article height, and a pair of third-sheet side-flap portions, which extend laterally from the third-sheet side portions, respectively, to longitudinal edges thereof substantially equal in length to said predetermined length and spaced from the outer pair o longitudinal scored lines by substantially one-half said predetermined width. The third-sheet further includes a pair of third-sheet end portions, which extend longitudinally from the third-sheet central portion ends, respectively, to an outer pair of transverse scored lines equal in length to said predetermined width and spaced from the inner pair of transverse scored lines by at least the article height, and a pair of third-sheet end-flap portions, which extend longitudinally from the third-sheet end portions, respectively, to transverse edges thereof substantially equal in length to said predetermined width and spaced from the outer pair of transverse scored lines by at most one-half said predetermined length. The third-sheet underlies the second-sheet so that the second-sheet central portion is longitudinally aligned with and centrally disposed on the third-sheet central portion, the pairs of third-sheet end and side portions then being folded about the inner pairs of transverse and longitudinal scored lines, respectively, into spaced confronting relation with the folded pairs of first-sheet end portions and second-sheet side portions, respectively, whereupon the pairs of third-sheet end-flap and side-flap portions are folded about the outer pairs of transverse and longitudinal scored lines, respectively, into adjacent confronting relation with the folded pairs of first-sheet and second-sheet flap portions.

The invention, and its objects and advantages, will become more apparent in the detailed description of the illustrated embodiment thereof presented hereinbelow.

BRIEF DESCRIPTION OF THE DRAWINGS

In the detailed description of two embodiments of this invention presented below, reference is made to the accompanying drawings, wherein like reference characters denote like elements, and wherein.

DESCRIPTION OF THE ILLUSTRATED EMBODIMENTS

Because certain parts of article packaging arrangements are well known, the following description is directed in particular to those elements forming, :operating directly with, or relating especially to, this invention. Elements not specifically shown or described herein are selectable from those known in the pertinent art.

Figure 1:
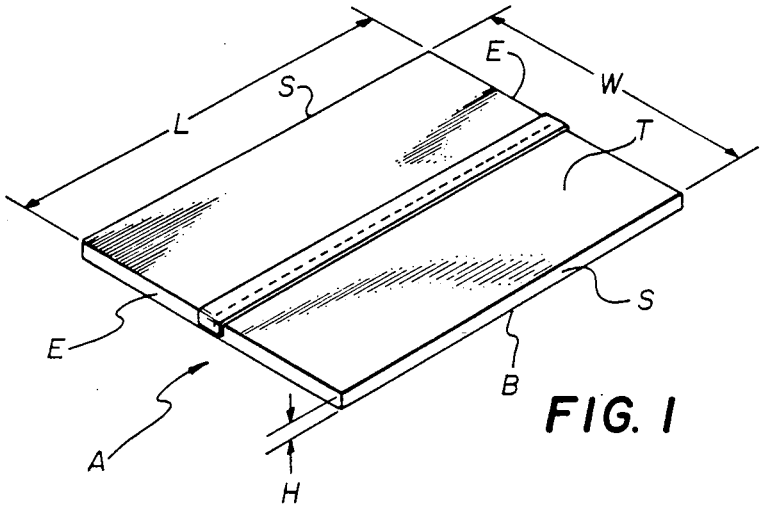
FIG. 1 is a top perspective view of a rectanguloid article to be contained by the packaging arrangement of this invention.

FIG. 1 illustrates, in perspective, a rectanguloid article A that is to be securely contained by the customized packaging arrangement of this invention. The term "rectanguloid" is intended to denote a shape generally conforming to that of a rectangular parallelepiped, or rectangular solid. By way of example, article A may comprise a stack of rectangular photosensitive film sheets, or plates, covered by an opaque wrapper that has been taped closed as shown. As received for packaging, article A has a given length L, a given width W, and a given height H, which together define opposite sides S, opposite ends E, and opposite bottom and top surfaces B and T respectively.

FIGS. 2–8 illustrate three sheets of corrugated paperboard that are sized, scored, joined, folded, and sealed closed around article A so as to form protective inner and outer packages of a packaging arrangement conforming to the first-described embodiment of this invention; while corresponding FIGS. 9–15 illustrate, in similar fashion, formation of a packaging arrangement according to the second-described embodiment.

Figure 2:
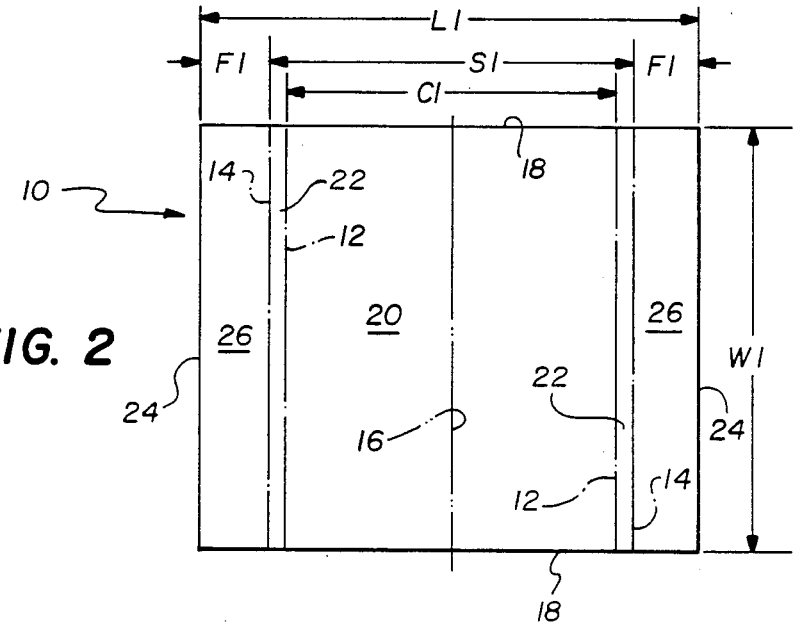
FIG. 2 is a top plan view of a first rectangular paperboard sheet incorporated into the first-described embodiment of the packaging arrangement of this invention.

Referring now to the first embodiment, FIG. 2 depicts a first, substantially rectangular, corrugated paperboard sheet 10 having a first-sheet thickness t1 (not shown), a first-sheet width W1 substantially equal to the article length L, and a first-sheet length L1 that is greater than the article width W plus twice the article height H but not greater than twice the article width W plus twice the article height H. That is, $W1=L$, and $L1>(W+2H)$ but $\leqq(2W+2H)$. Thus, $W1=L$, and $(W+2H)<L1\leqq 2(W+H)$. First sheet 10 also has transversely oriented, longitudinally spaced pairs of parallel inner and outer scored lines 12 and 14, respectively, that are symmetrically disposed thereon about transverse centerline 16. The two inner scored lines 12 are spaced apart by an amount C1 substantially equal to the article width W plus a score-line allowance a (not shown), i.e., $C1=W+a$. The two outer scored lines 14 are spaced from each other by an amount S1 substantially equal to the inner line spacing Cl plus twice the article height H plus another score-line allowance, i.e., $S1=C1+2H+a=W+a+2H+a=W+2H+2a=W+2(H+a)$. The inner scored lines 12 and the longitudinal edges 18 of first-sheet 10 together define a first-sheet rectangular central portion 20 that substantially conforms, in both shape and size, with the article bottom surface B. Each inner scored line 12, the outer scored line 14 nearby, and longitudinal edges 18 together define a first-sheet rectangular side portion 22 that extends longitudinally from central portion 20 and substantially conforms, in both shape and size, with one of the article sides S. Similarly, each outer scored line 14, the nearer one of transverse edges 24, and longitudinal edges 18 together define a first-sheet rectangular flap portion 26 that extends longitudinally from the adjacent side portion 22 and substantially conforms, in shape and size, to a portion of the article top surface T. Preferably, each flap portion 26 extends from the adjacent side portion 22 by an amount F1 that is between one-tenth and one-half the article width W, i.e., $W/10<F1<W/2$. In use, the central portion 20 is adapted to support the article bottom surface B thereon, after which the side portions 22 and flap portions 26 are folded about the inner scored lines 12 and outer scored lines 14 respectively, and are thus brought into adjacent confronting relation with the article sides S and article top surface T respectively.

Figure 3:
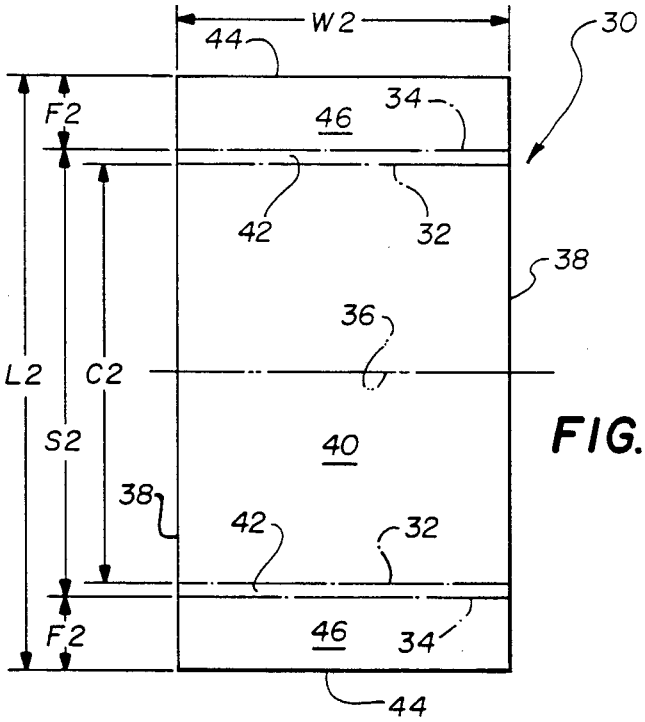
FIG. 3 is a top plan view of a second rectangular paperboard sheet incorporated into the first-described embodiment.

FIG. 3 depicts a second, substantially rectangular, corrugated paperboard sheet 30 having a second-sheet thickness t2 (not shown), a second-sheet width W2 substantially equal to the article width W, and a second-sheet length L2 that is greater than the article length L plus twice the article height H but not greater than twice the article length L plus twice the article height H. That is, $W2=W$, and $L2>(L+2H)$ but $\leqq(2L+2H)$. Thus, $W2=W$, and $(L+2H)<L2\leqq 2(L+H)$. Second sheet 30 also has transversely oriented, longitudinally spaced pairs of parallel inner and outer scored lines 32 and 34, respectively, that are symmetrically disposed thereon about transverse centerline 36. The two inner scored lines 32 are spaced apart by an amount C2 substantially equal to the article length L plus a score-line allowance b (not shown), i.e., $C2=L+b$. The two outer scored lines 34 are spaced from each other by an amount S2 substantially equal to the inner line spacing C2 plus twice the sum of the article height H and the first-sheet thickness t1 plus another score-line allowance, i.e., $S2=C2+2(H+t1)+b=L+b+2(H+t1)+b=L+2(H+t1)+2b=L+2(H+t1+b)$. The inner scored lines 32 and the longitudinal edges 38 of second-sheet 30 together define a second-sheet rectangular central portion 40 that substantially conforms, in both shape and size, with the first-sheet central portion 20. Each inner scored line 32, the outer scored line 34 nearby, and longitudinal edges 38 together define a second-sheet rectangular end portion 42 that extends longitudinally from central portion 40 and substantially conforms, in both shape and size, with one of the article ends E. Similarly, each outer scored line 34, the nearer one of transverse edges 44, and longitudinal edges 38 together define a second-sheet rectangular flap portion 46 that extends longitudinally from the adjacent end portion 42 and substantially conforms, in shape and size, with a portion of the article top surface T. Preferably, ea:h flap portion 46 extends from the adjacent end portion 42 by an amount F2 that is between one-tenth and one-half the article length L, i.e., $L/10<F2<L/2$. In use, the second-sheet 30 is positioned to underlie the first-sheet 10 transversely thereto so that the second-sheet central portion 40 is in registered supporting relation with the first-sheet central portion 20, after which the second-sheet end portions 42 and flap portions 46 are folded about the second-sheet inner scored lines 32 and outer scored lines 34 respectively, and are thus brought into adjacent confronting relation with the article ends E and article top surface T respectively (when article A is supported on first-sheet central portion 20).

Figure 4:
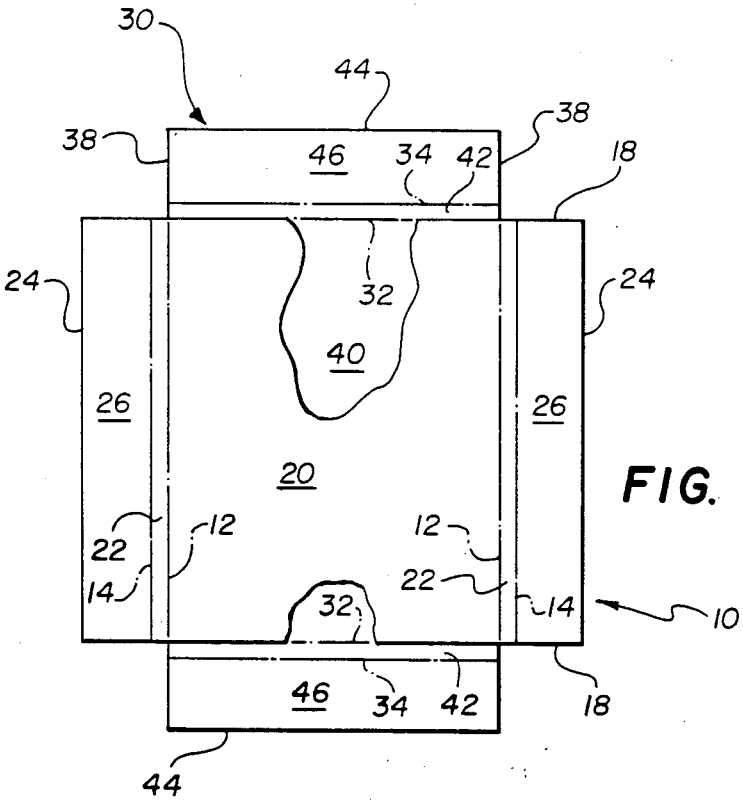
FIG. 4 is a top plan view of the first and second sheets of FIGS. 2 and 3, respectively, showing the first-sheet superposed transversely and symmetrically upon, and secured to, the second-sheet.

FIG. 4 shows first-sheet 10 superposed transversely upon second sheet 30, with first-sheet central portion 20 secured in registered overlying relation to second-sheet central portion 40 by adhesive means provided at their interface. Such means may conveniently comprise any commonly used case sealing hot melt glue applied to either of the facing surfaces of central portions 20 and 40.

Figure 5:
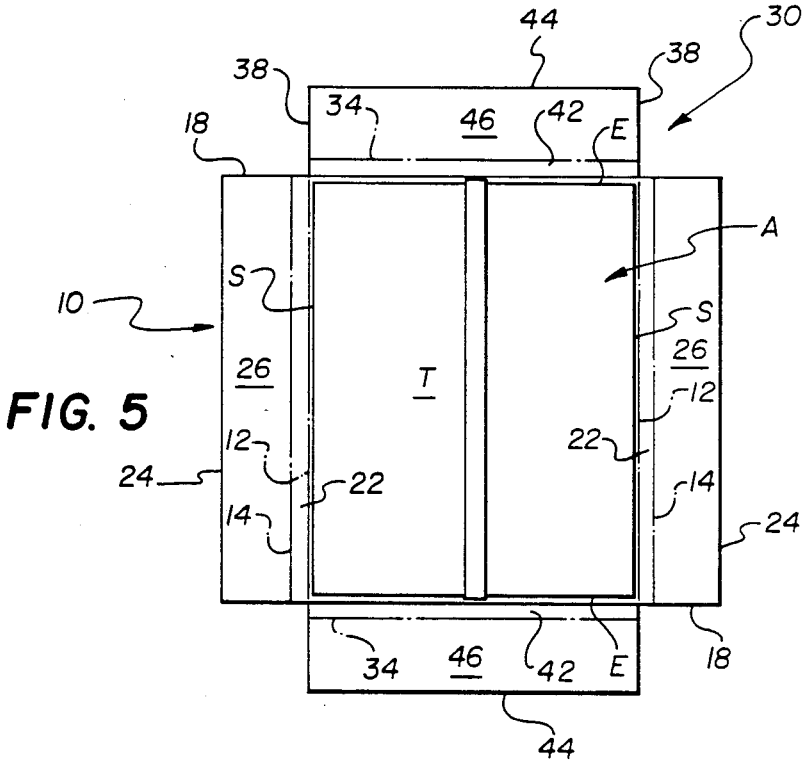
FIG. 5 is a top plan view of the joined first and second-sheets of FIG. 4, showing the rectanguloid article of FIG. 1 disposed centrally upon the first sheet.

FIG. 5 illustrates the glued together first and second-sheets 10 and 30 of FIG. 4 with article A of FIG. 1 placed thereon so that the article bottom surface B is in registered overlying relation to first-sheet central portion 20 and the article top surface T is facing upward.

Figure 6:
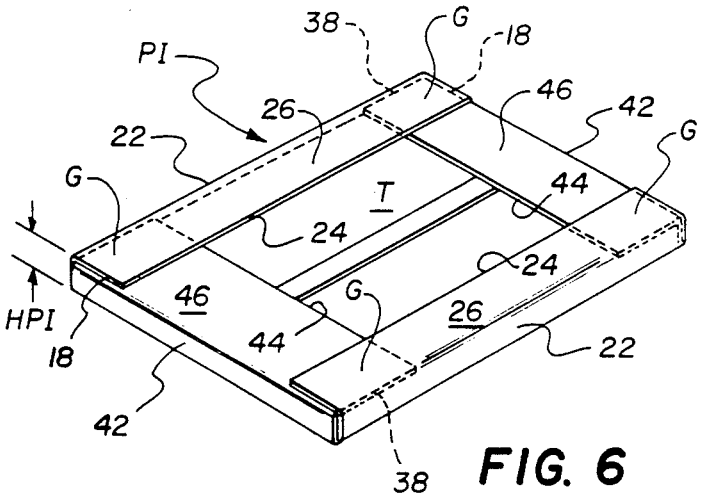
FIG. 6 is a top perspective view of the article and sheets combination depicted in FIG. 5, showing portions of both sheets therein folded closely about, and secured in overlapping relation upon, the article to form an inner package therearound.

FIG. 6 portrays an inner package PI comprising the glued together sheets and article of FIG. 5 with second-sheet end portions 42 and flap portions 46 folded, about scored lines 32 and 34 respectively, into contact with article ends E and end portions of article top surface T respectively, and with first-sheet side portions 22 and flap portions 26 folded, about scored lines 12 and 14 respectively, into contact with article sides S and second-sheet flap portions 46 respectively, flap portions 26 being secured in their overlapping contact with flap portions 46 by adhesive means, such as the aforementioned hot melt glue, provided at their interfacing surfaces in package corner areas G. The resulting inner package PI has an overall height HPI substantially equal to $H+2(t1+t2)$.

Figure 7:
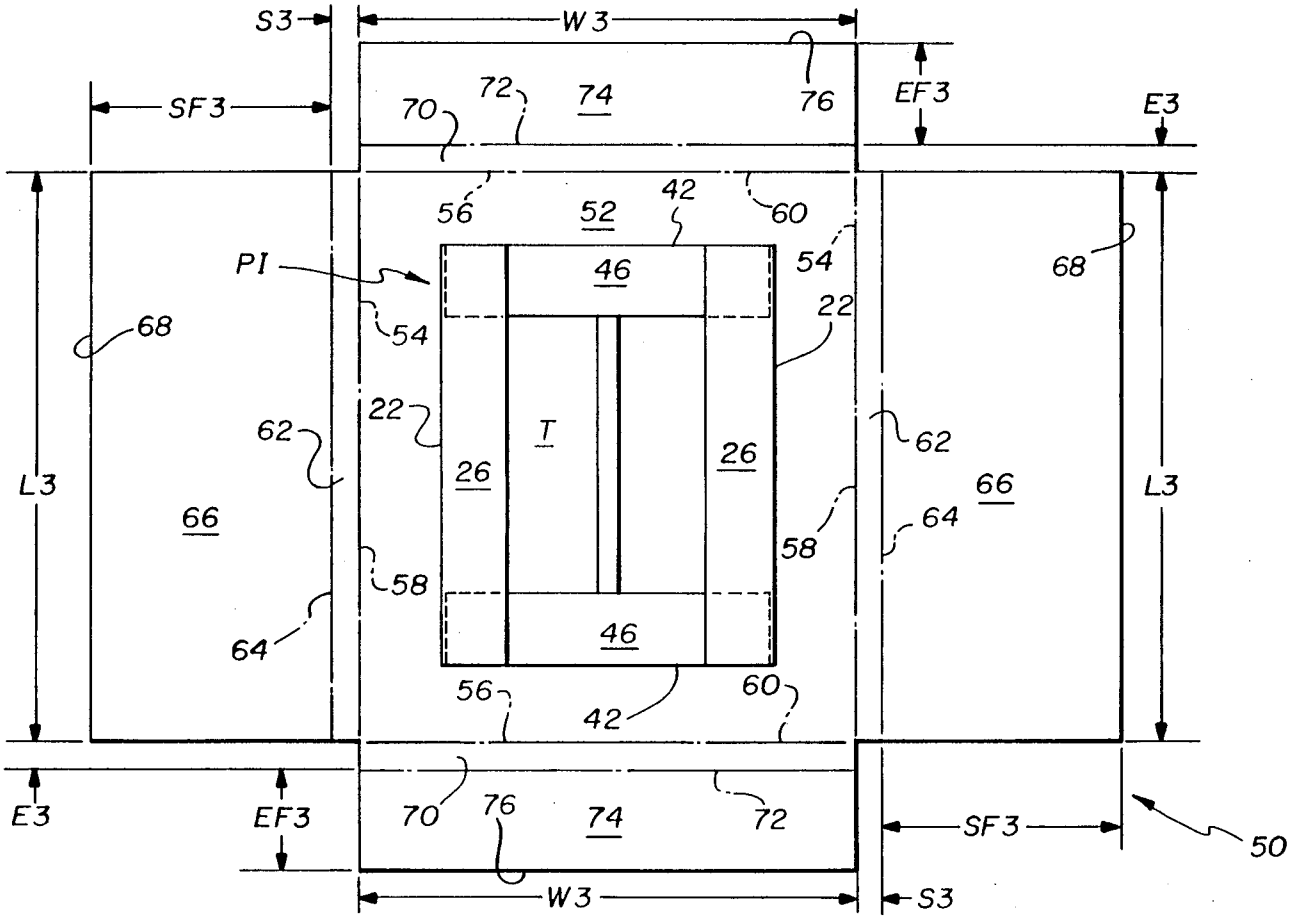
FIG. 7 is a top plan view of the inner package of FIG. 6 disposed centrally upon, and secured to, a larger rectangular central portion of a third paperboard sheet incorporated into the first-described embodiment.

FIG. 7 depicts a third corrugated paperboard sheet 52 that includes a third-sheet rectangular central portion 52 having opposite sides 54 and opposite ends 56 of predetermined length L3 and width W3, respectively, which are greater than the article length L and width W, respectively, whereby the third-sheet central portion 52 is larger in area than the first-sheet and second-sheet central portions 20 and 40. Preferably, the predetermined length L3 and width W3 are at least five percent greater than the article length L and width W respectively. The third-sheet central portion sides 54 are defined by an inner pair of longitudinal scored lines 58 that are equal in length to the predetermined length L3 and separated from each other by the predetermined width W3. Similarly, the third-sheet central portion ends 56 are defined by an inner pair of transverse scored lines 60 that are equal in length to the predetermined width W3 and separated from each other by the predetermined length L3. Third sheet 50 also includes a pair of third-sheet side portions 62, which extend laterally from the central portion sides 54, respectively, to an outer pair of longitudinal scored lines 64. Lines 64 are equal in length to the predetermined length L3 and are spaced from the inner pair of longitudinal scored lines 58 by an amount S3 that is at least equal to the article height H, preferably equal to the overall height HPI of inner package PI plus a score-line allowance c (not shown), whereby the spacing amount S3 is substantially equal to $HPI+c=H+2(t1+t2)+c$. Third sheet 50 additionally includes a pair of third-sheet side-flap portions 66, which extend laterally from side portions 62, respectively, to longitudinal edges 68 thereof. Edges 68 are substantially equal in length to the predetermined length L3 and are spaced from the outer pair of longitudinal scored lines 64 by an amount SF3 that is substantially equal to one-half the predetermined width W3, more particularly one-half W3 plus the score-line allowance c, whereby $SF3=W3/2+c$. Third sheet 50 further includes a pair of third-sheet end portions 70, which extend longitudinally from the central portion ends 56, respectively, to an outer pair of transverse scored lines 72. Lines 72 are equal in length to the predetermined width W3 and are spaced from the inner pair of transverse scored lines 60 by an amount E3 that is at least equal to the article height H, preferably equal to the inner package height HPI plus the score-line allowance c, whereby the spacing amount E3 is substantially equal to $HPI+c=H+2(t1+t2)+c$, i.e., $E3=S3$. Third sheet 50 finally includes a pair of third-sheet end-flap portion 74, which extend longitudinally from end portions 70, respectively, to transverse edges 76 thereof. Edges 76 are substantially equal in length to the predetermined width W3 and are spaced from the outer pair of transverse scored lines 72 by an amount EF3 that preferably is at least one-tenth and at most one-half the predetermined length L3 plus the score-line allowance c, i.e., $(L3/10+c)\leqq EF3\leqq(L3/2+c)$. In use, as illustrated in FIG. 7, the third-sheet 50 is positioned to underlie the inner package PI so that the second-sheet central portion 40 at the bottom of package PI is longitudinally aligned with and centrally disposed on the third-sheet central portion 52, after which the pairs of third-sheet side and end portions 62 and 70 are to be folded about the inner pairs of longitudinal and transverse scored lines 58 and 60 respectively, and thus brought into spaced confronting relation with the folded pairs of first-sheet side portions 22 and second-sheet end portions 42 respectively, whereupon the pairs of third-sheet side-flap and end-flap portions 66 and 74 are folded about the outer pairs of longitudinal and transverse scored lines 64 and 72, respectively, into adjacent confronting relation with the folded pairs of first-sheet and second-sheet flap portions 26 and 46. To firmly maintain the inner package PI in its aligned, centered position on third-sheet central portion 52, and thus keep the inner package protectively spaced from the third-sheet side and end portions 62 and 70, the second-sheet central portion 40 of the inner package is secured to the third-sheet central portion 52 by adhesive means such as the aforementioned hot melt glue applied to either of their interfacing surfaces.

Figure 8:
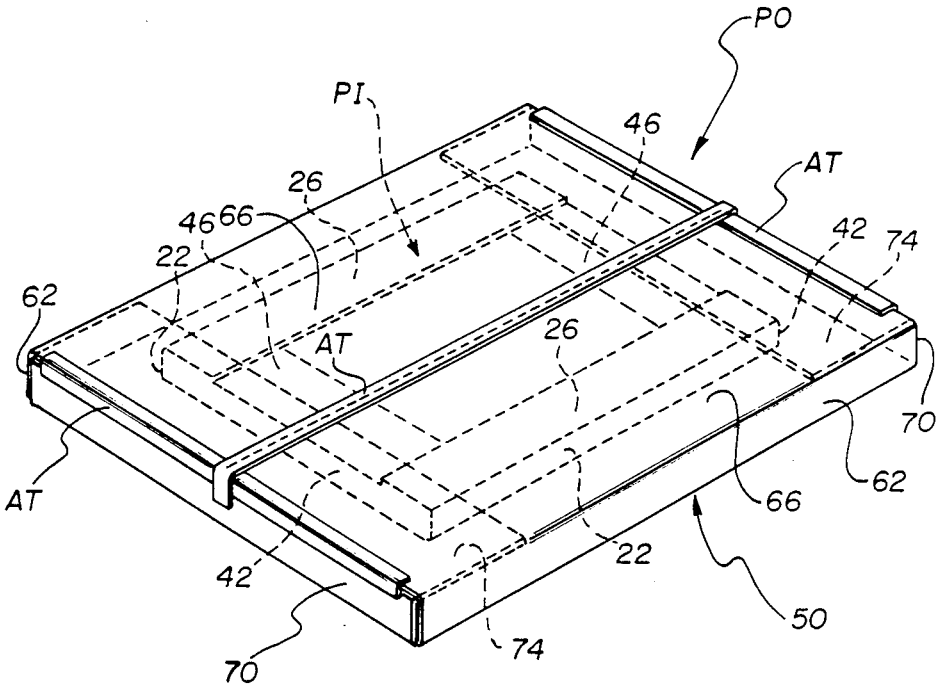
FIG. 8 is a top perspective view of the inner package and third-sheet combination depicted in FIG. 7, showing symmetrical side and end portions of the third-sheet folded in spaced relation about, and secured in covering relation upon, the inner package to form a protective outer package therearound.
Figure 1:
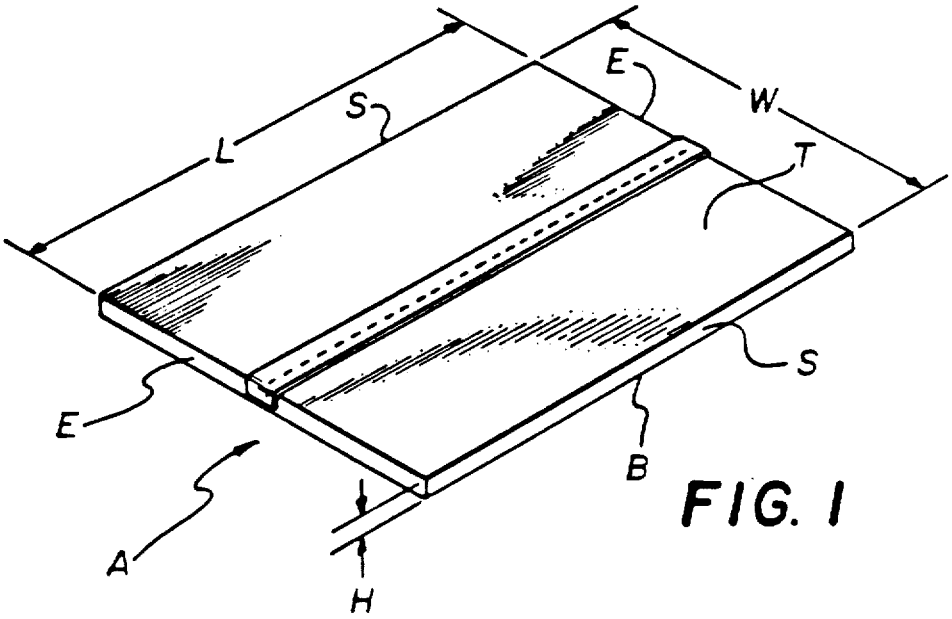
Figure 3:
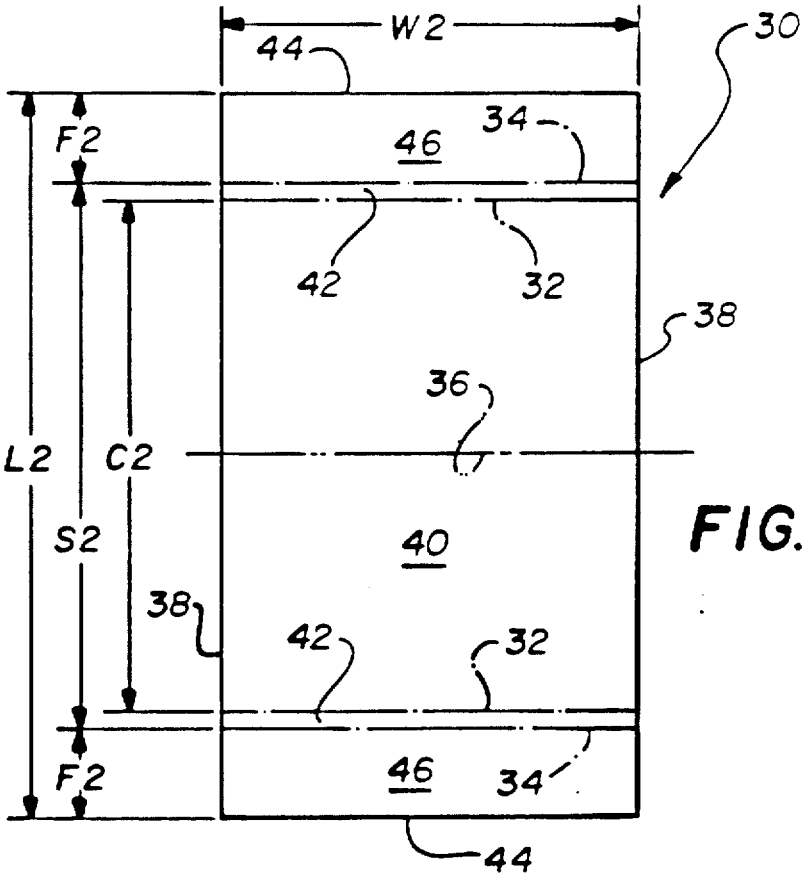
Figure 2:
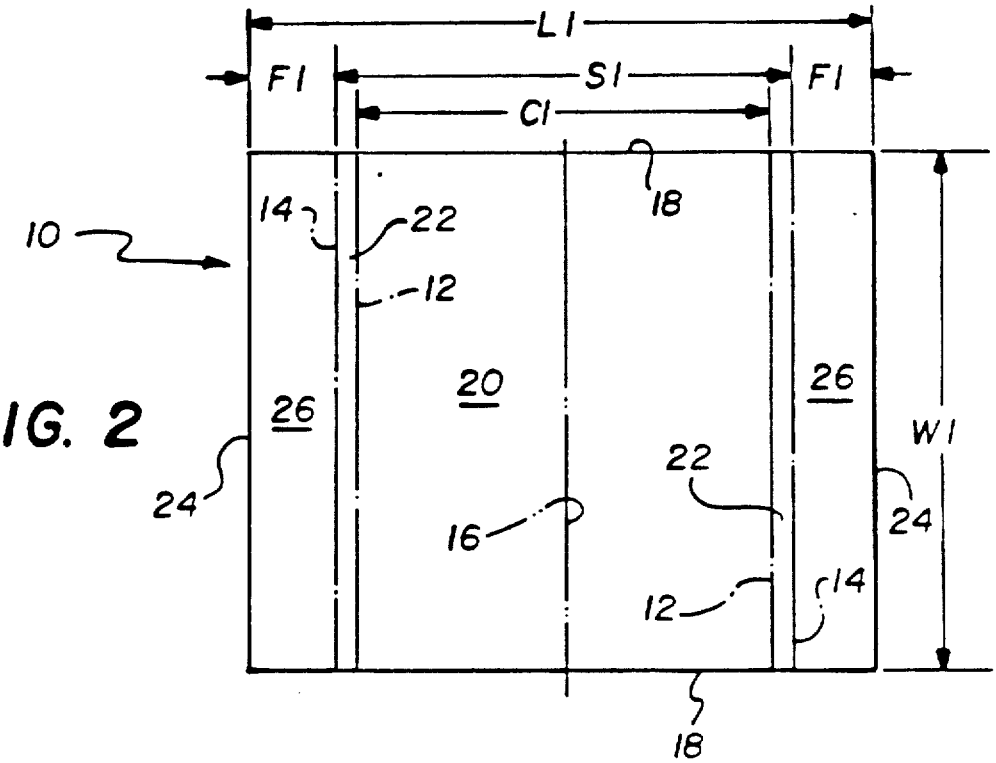
Figure 4:
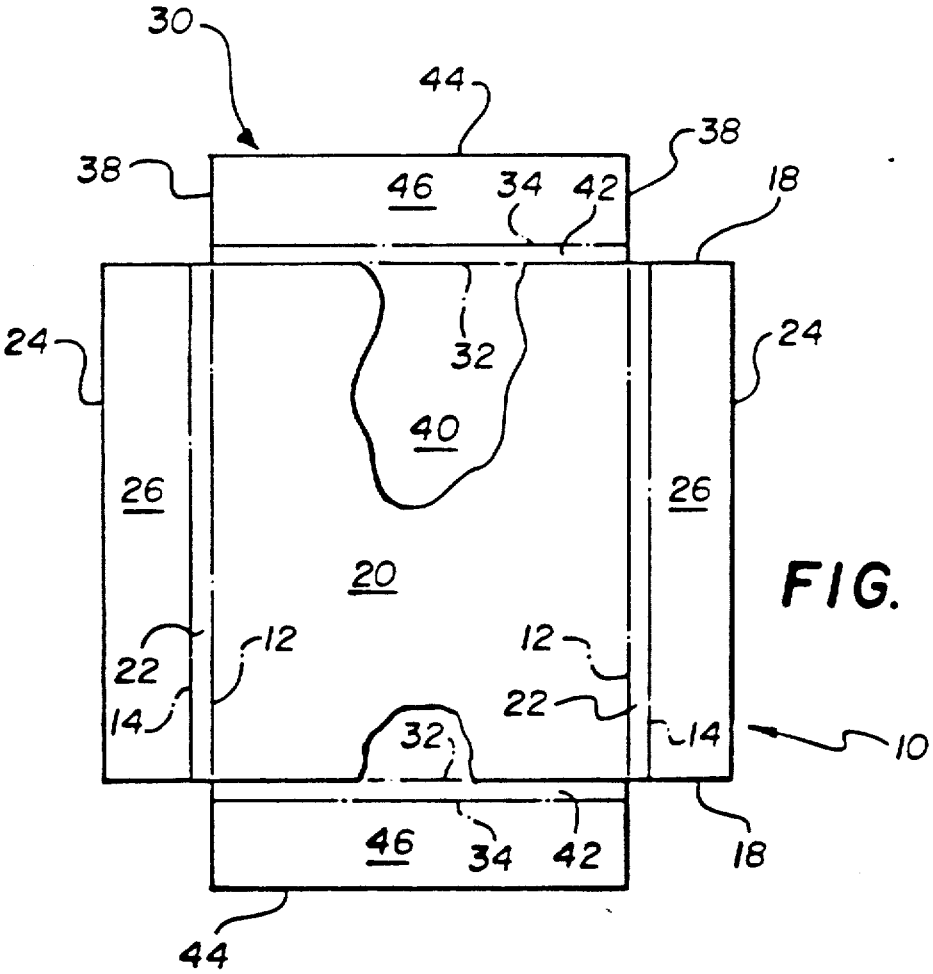
Figure 5:
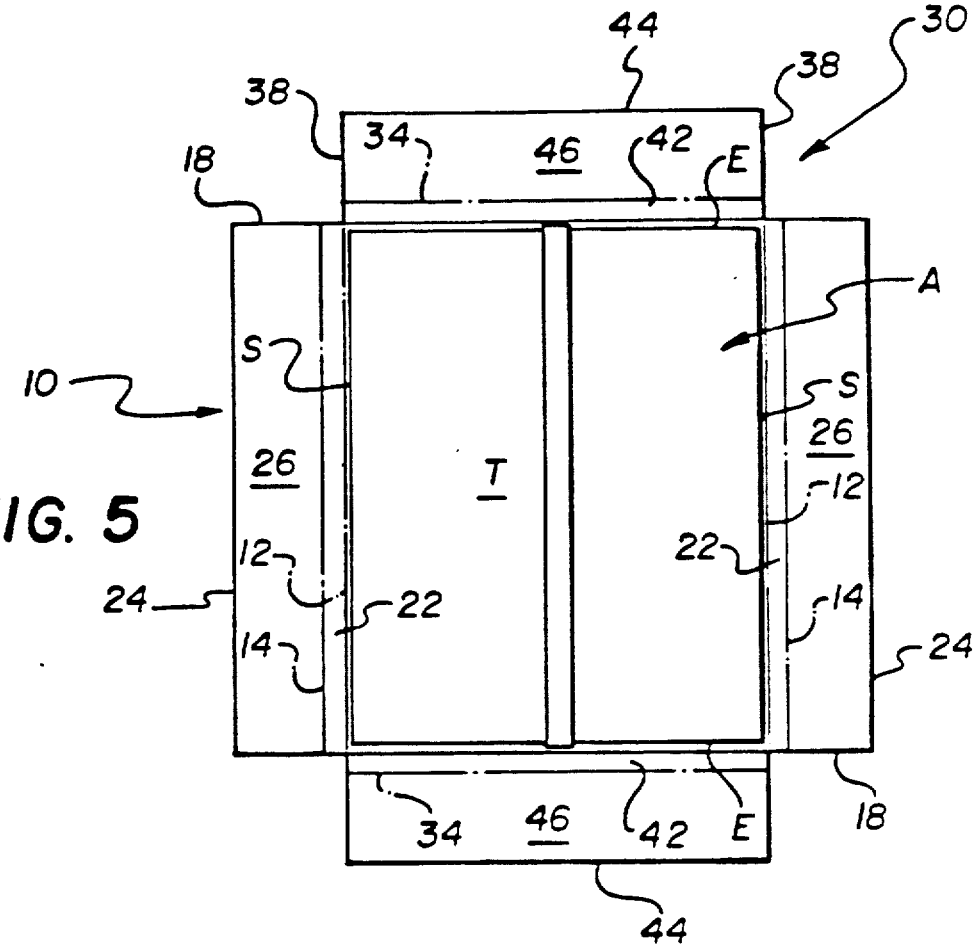
Figure 6:
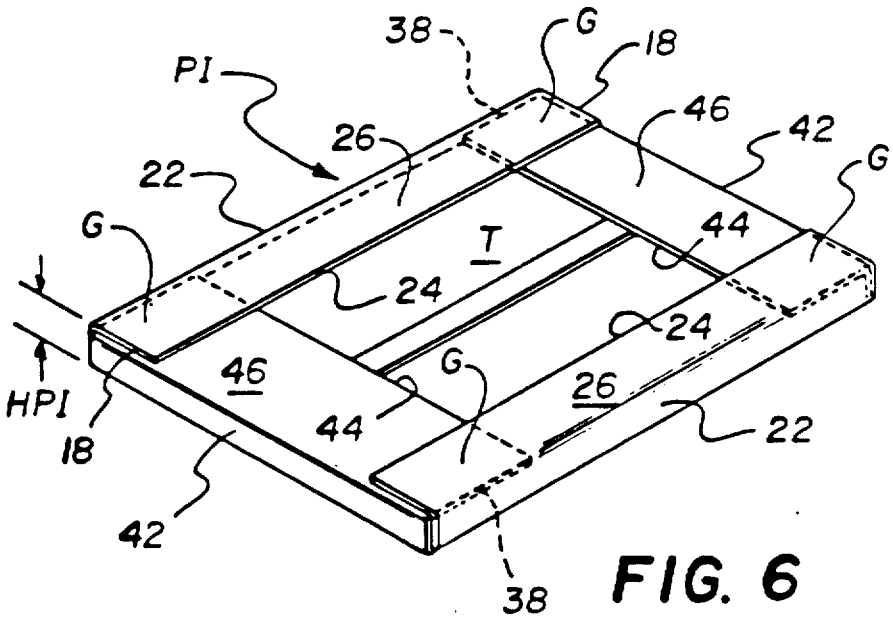
Figure 7:
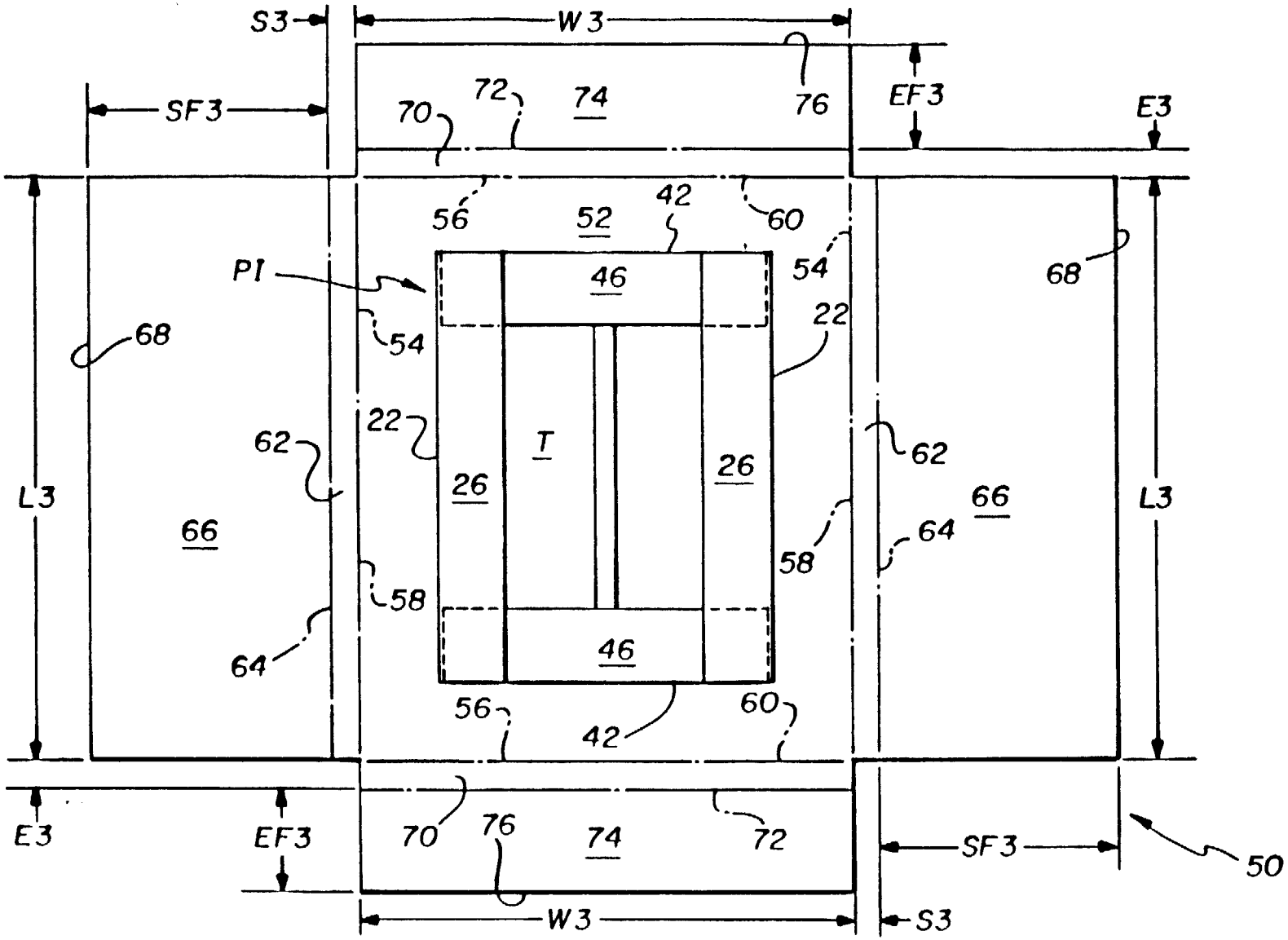
Figure 8:
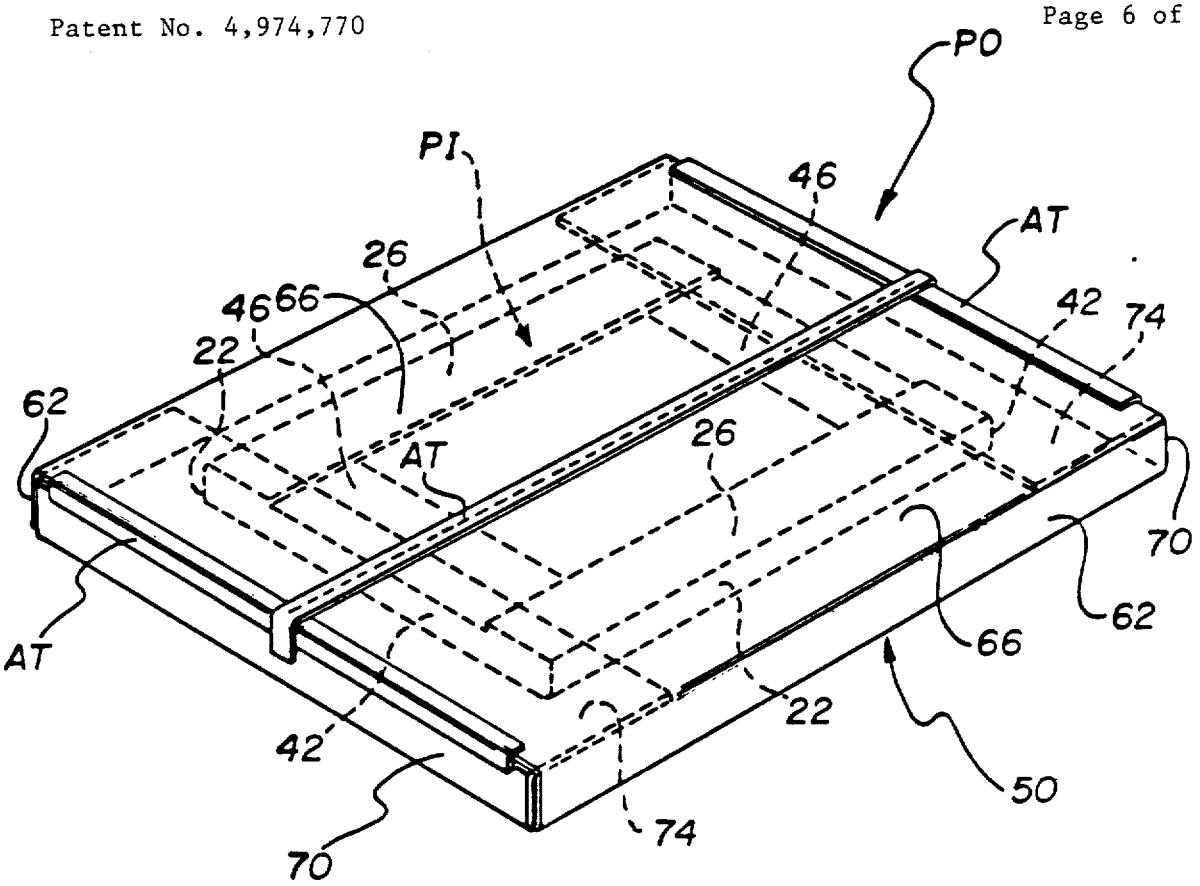

FIG. 8 portrays the final outer package PO comprising the glued together third-sheet 50 and inner package PI of FIG. 7 with third-sheet side and end portions 62 and 70 folded, about scored lines 58 and 60 respectively, into spaced confronting relation with folded first-sheet side portions 22 and folded second-sheet end portions 42 respectively, and with third-sheet end-flap and side-flap portions 74 and 66 folded, about scored lines 72 and 64 respectively, into contact with folded first-sheet flap portions 26 and folded third-sheet end-flap portions 74 respectively, the side-flap portions 66 being firmly secured in their overlapping contact with end-flap portions 74 by strips of adhesive tape AT joining side-flap portions 66 to each other and to third-sheet end portions 70 as shown, thereby maintaining the folded third-sheet side-flap and end-flap portions 66 and 74 in their aforementioned adjacent confronting relation with the folded first-sheet and second-sheet flap portions 26 and 46 of the inner package.

Referring next to the second, and preferred, embodiment of this invention, it should be noted at the outset that this embodiment is identical to the first embodiment except that the positions and sequence of folding of the first and second sheets, relative to the article, are now reversed. This embodiment is illustrated in FIGS. 9–15, which correspond closely to FIGS. 2–8 and bear the same reference characters used therein but with primes (′) added to distinguish the second embodiment.

Figure 9:
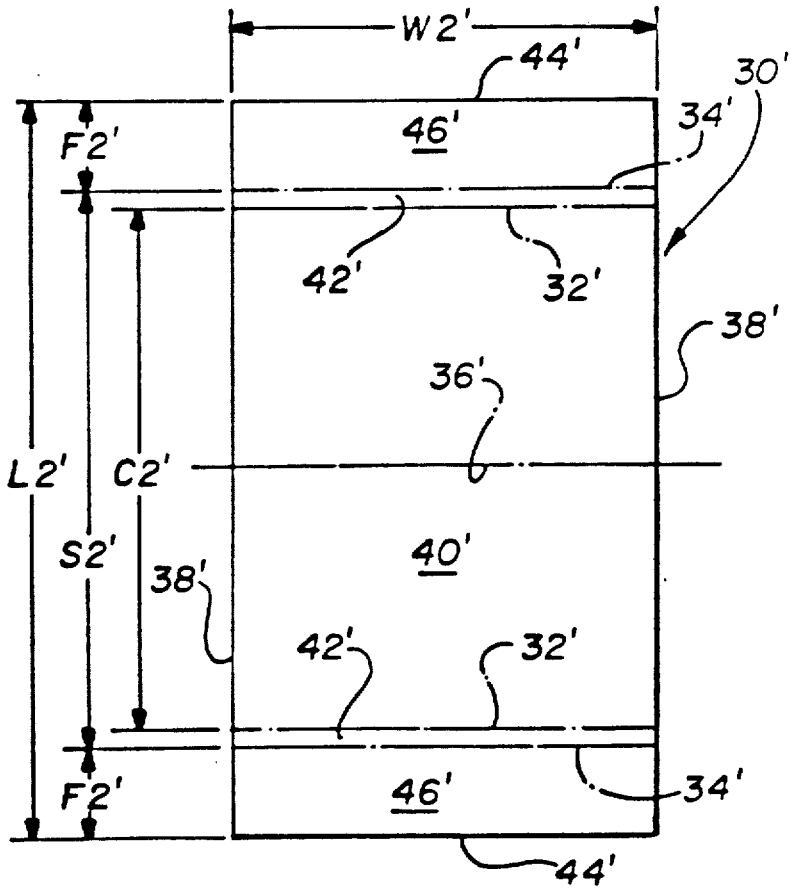
FIG. 9 is a top-plan view of a first rectangular paperboard sheet incorporated into the second-described embodiment of the packaging arrangement of this invention.

FIG. 9 is similar to FIG. 3 of the first embodiment but depicts, for this embodiment, a first, substantially rectangular, corrugated-paperboard sheet 30′ having a first-sheet thickness t2′ (not shown), a first-sheet width W2′ substantially equal to the article width W, and a first-sheet length L2′ that is greater than the article length L plus twice the article height H but not greater than twice the article length L plus twice the article height H. This is, $W2'=W$, and $L2'>(L+2H)$ but $\leqq(2L+2H)$. Thus, $W2'=W$, and $(L+2H)<L2'\leqq2(L+H)$. First sheet 30′ also has transversely oriented, longitudinally spaced pairs of parallel inner and outer scored lines 32′ and 34′, respectively, that are symmetrically disposed thereon about transverse centerline 36′. The two inner scored lines 32′ are spaced apart by an amount C2′ substantially equal to the article length L plus a score-line allowance b′ (not shown), i.e., $C2'+L+b'$. The two outer scored lines 34′ are spaced from each other by an amount S2′ substantially equal to the inner-line spacing C2′ plus twice the article height H plus another score-line allowance, i.e., $S2'=C2'=2H=b'+L=b'=2H=b'+L=2H=2b'+L-=2(H=b')$. The inner scored lines 32′ and the longitudinal edges 38′ of first-sheet 30′ together define a first-sheet rectangular central portion 40′ that substantially conforms, in both shape and size, with the article bottom surface B. Each inner scored line 32′, the outer scored line 34′ nearby, and longitudinal edges 38′ together define a first-sheet rectangular end portion 42′ that extends longitudinally from central portion 40′ and substantially conforms, in both shape and size, with one of the article ends E. Similarly, each outer scored line 34′, the nearer one of transverse edges 44′, and longitudinal edges 38′ together define a first-sheet rectangular flap portion 46′ that extends longitudinally from the adjacent end portion 42′ and substantially conforms, in shape and size, with a portion o f the article top surface T. Preferably, each flap portion 46′ extends from the adjacent end portion 42′ by an amount F2′ that is between one-tenth and one-half the article length L, i.e., $L/10<F2'<L/2$. In use, the central portion 40′ is adapted to support the article bottom surface B thereon, after which the end portion 42′ and flap portions 46′ are folded about the inner scored lines 32′ and outer scored lines 34′ respectively, and are thus brought into adjacent confronting relation with the article ends E and article top surface T respectively.

Figure 10:
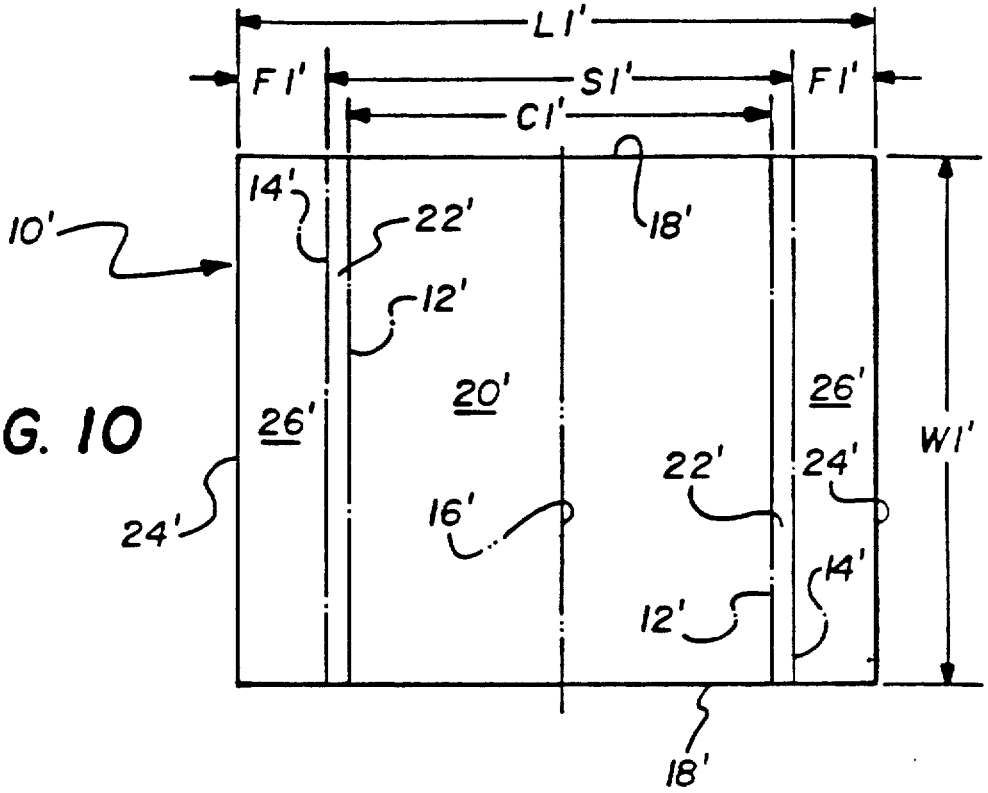
FIG. 10 is a top-plan view of a second rectangular paperboard sheet incorporated into the second-described embodiment.

FIG. 10 is similar to FIG. 2 of the first embodiment but depicts, for this embodiment, a second, substantially rectangular, corrugated-paperboard sheet 10′ having a second-sheet thickness t1′ (not shown), a second-sheet width W1′ substantially equal to the article length L, and a second-sheet length L1′ that is greater than the article width W plus twice the article height h but not greater than twice the article width W plus twice the article height H. That is, $W1'+L$, and $L1'>(W=2H)$ but $\leqq(2W=2H)$. Thus, $W1'+L$, and $(W=2H)<L1'\leqq 2(W=H)$. Second sheet 10′ also has transversely oriented, longitudinally spaced pairs of parallel inner and outer scored lines 12′ and 14′, respectively, that are symmetrically disposed thereon about transverse centerline 16′. The two inner scored lines 12′ are spaced apart by an amount C1′ substantially equal to the article width W plus a score-line allowance a′(not shown), i.e., $C1'+W=a'$. The two outer scored lines 14′ are spaced from each other by an amount S1′ substantially equal to the inner-line spacing C1′ plus twice the sum of the article height H and the first-sheet thickness t2′ plus another score-line allowance, i.e., $S1'+C1'=2(H=t2')=a'+W=a'=2(H=t2'-)=a+W=2(H=t2')=2a'+W=2 \quad (H=t2'=a')$. The inner scored lines 12′ and the longitudinal edges 18′ of second-sheet 10′ together define a second-sheet rectangular central portion 20′ that substantially conforms, in both shape and size, with the first-sheet central portion 40′. Each inner scored line 12′, the outer scored line 14′nearby, and longitudinal edges 18′ together define a second-sheet rectangular side portion 22′ that extends longitudinally from central portion 20′ and substantially conforms, in both shape and size, with one of the article sides S. Similarly, each outer scored line 14′, the nearer one of transverse edges 24′, and longitudinal edges 18′ together define a second-sheet rectangular flap portion 26′ that extends longitudinally from the adjacent side portion 22′ and substantially conforms, in shape and size, with a portion of the article top surface T. Preferably, each flap portion 26′ extends from the adjacent side portion 22′ by an amount F1′ that is between one-tenth and one-half the article width W, i.e., $W/10<F1'<W/2$. In use, the second-sheet 10′is positioned to underlie the first-sheet 30′ transversely thereto so that the second-sheet central portion 20′ is in registered supporting relation with the first-sheet central portion 40′, after which the second-sheet side portions 22′ and flap portions 26′ are folded about the second-sheet inner scored lines 12′ and outer scored lines 14′ respectively, and are thus brought into adjacent confronting relation with the article sides S and article top surface T respectively (when article A is supported on first-sheet central portion 40′).

Figure 11:
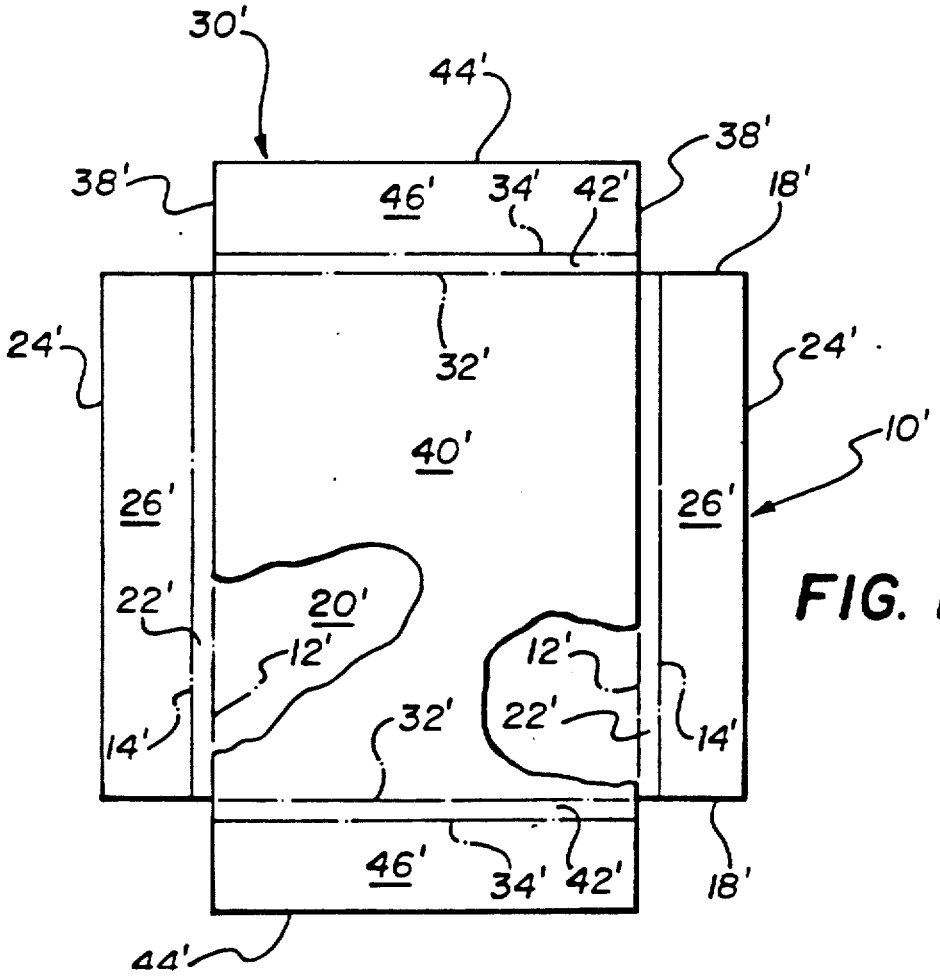
FIG. 11 is a top-plan view of the first and second-sheets of FIGS. 9 and 10, respectively, showing the first-sheet superposed transversely and symmetrically upon, and secured to, the second-sheet.

FIG. 11 is similar to FIG. 4 of the first embodiment but shows, for this embodiment, first-sheet 30′ superposed transversely upon second-sheet 10′, with first-sheet central portion 40′ secured in registered overlying relation to second-sheet central portion 20′ by adhesive means provided at their interface. As in the first embodiment, such means may conveniently comprise any commonly used case-sealing hot-melt glue applied to either of the facing surfaces of central portion 40′ and 20′.

Figure 12:
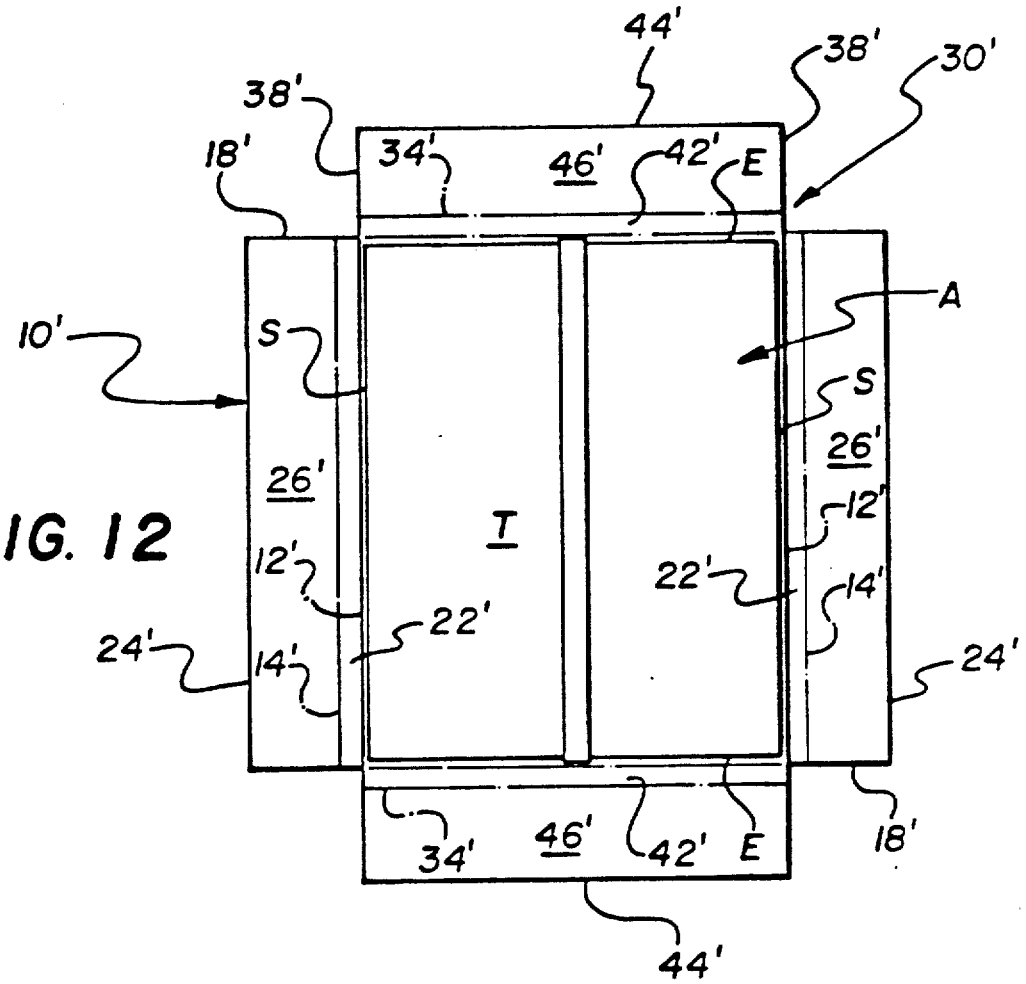
FIG. 12 is a top-plan view of the joined first and second-sheets of FIG. 11, showing the rectanguloid article of FIG. 1 disposed centrally upon the first-sheet.

FIG. 12 is similar to FIG. 5 of the first embodiment but illustrates, for this embodiment, the glued-together first and second-sheets 30′ and 10′ of FIG. 11 with article A of FIG. 1 placed thereon so that the article bottom surface B is in registered overlying relation to first-sheet central portion 40′ and the article top surface T is facing upward.

Figure 13:
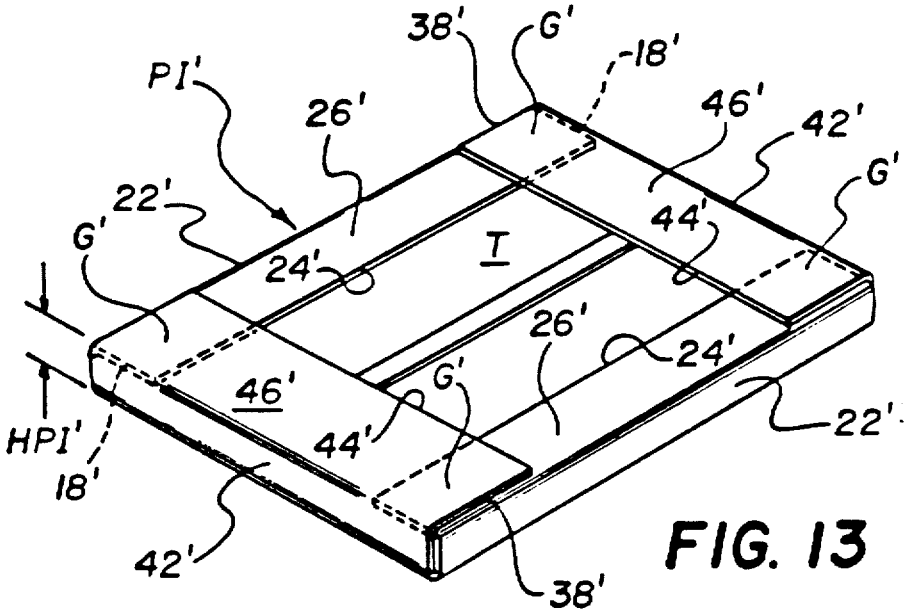
FIG. 13 is a top-perspective view of the article-and-sheets combination depicted in FIG. 12, showing portions of both sheets therein folded closely about, and secured in overlapping relation upon, the article to form an inner package therearound.

FIG. 13 is similar to FIG. 6 of the first embodiment but portrays, for this embodiment, an inner package PI′ comprising the glued-together sheets and article of FIG. 12 with second-sheet side portions 22′ and flap portions 26′ folded, about scored lines 12′ and 14′ respectively, into contact with article sides S and side portions of article top surface T respectively, and with first-sheet end portions 42′ and flap portions 46′ folded, about scored lines 32′ and 34′ respectively, into contact with article ends E and second-sheet flap portions 26′ respectively, flap portions 46′ being secured in their overlapping contact with flap portions 26′ by adhesive means, such as the aforementioned hot-melt glue, provided at their interfacing surfaces in package corner areas G′. The resulting inner package PI′ has an overall height HPI′ substantially equal to $H=2(t1'+t2')$.

Figure 14:
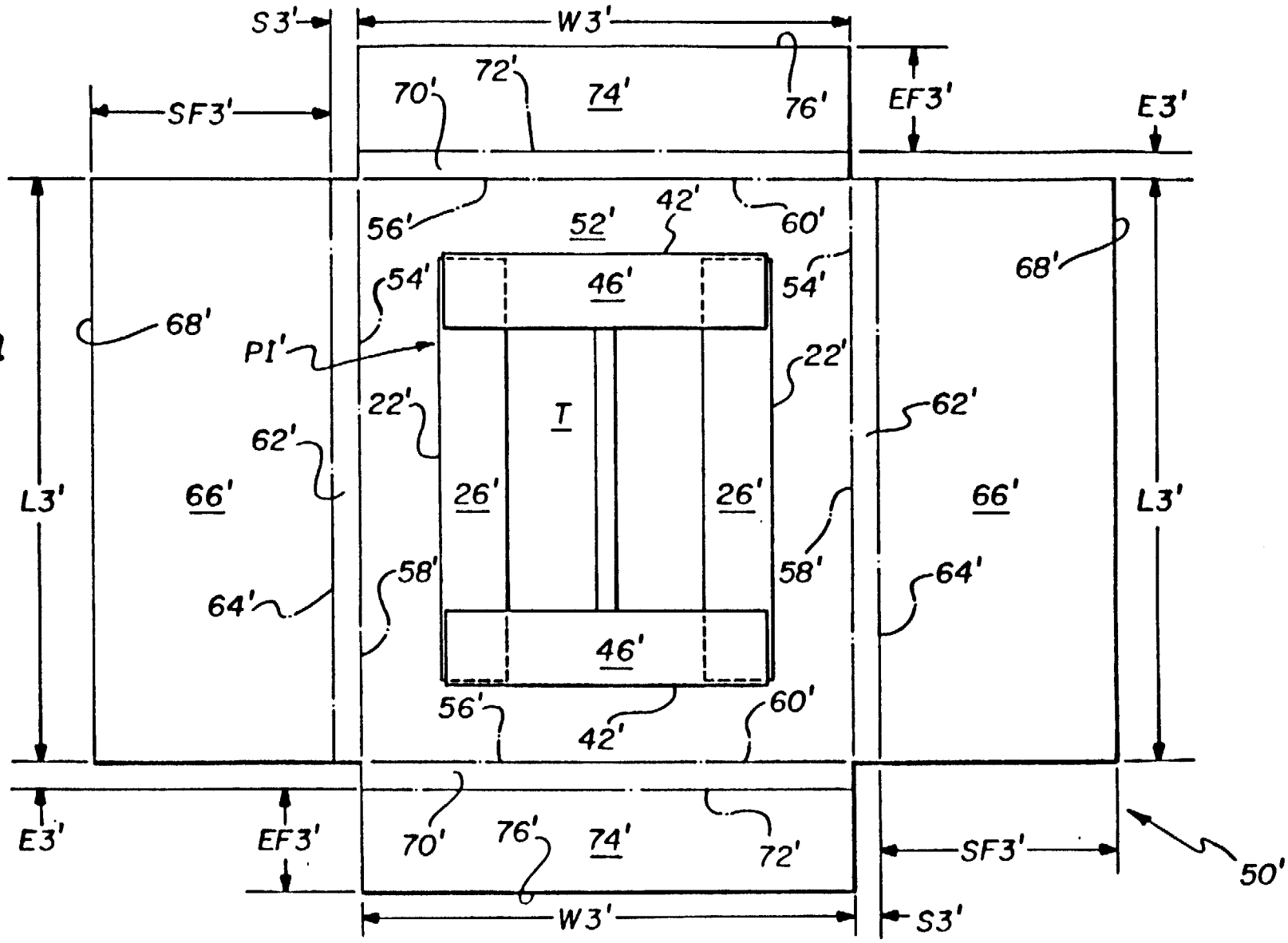
FIG. 14 is a top-plan view of the inner package of FIG. 13 disposed centrally upon, and secured to, a larger rectangular central portion of a third paperboard sheet incorporated into the second-described embodiment.

FIG. 14 is similar to FIG. 7 of the first embodiment but depicts, for this embodiment, a third corrugated-paperboard sheet 50′ that includes a third-sheet rectangular central portion 52′ having opposite sides 54′ and opposite ends 56′ of predetermined length L3′ and width W3′, respectively, which are greater than the article length L and width W, respectively, whereby the third-sheet central portion 52′ is larger in area than the first-sheet and second-sheet central portions 40′ and 20′. Preferably, the predetermined length L3′ and width W3′ are at least five percent greater than the article length L and width W respectively. The third-sheet central portion sides 54′ are defined by an inner pair of longitudinal scored lines 58′ that are equal in length to the predetermined length L3′ and separated from each other by the predetermined width W3′. Similarly, the third-sheet central portion ends 56′ are defined by an inner pair of transverse scored lines 60′ that are equal in length to the predetermined width W3′ and separated from each other by the predetermined length L3′. Third sheet 50′ also includes a pair of third-sheet side portions 62′, which extend laterally from the central portion sides 54′, respectively, to an outer pair of longitudinal scored lines 64′. Lines 64′ are equal in length to the predetermined length L3′ and are spaced from the inner pair of longitudinal scored lines 58′ by an amount S3′ that is at least equal to the article height H, preferably equal to the overall height HPI′ of inner package PI′ plus a score-line allowance c′ (not shown), whereby the spacing amount S3′ is substantially equal to $HPI'=c'+H=2(t1'=t2')=c'$. Third sheet 50′ additionally includes a pair of third-sheet side-flap portions 66′, which extends laterally from side portions 62′, respectively, to longitudinal edges 68′ thereof. Edges 68′ are substantially equal in length to the predetermined length L3′ and are spaced from the outer pair of longitudinal scored lines 64′ by an amount SF3′ that is substantially equal to one-half the predetermined width W3′, more particularly one-half W3′ plus the score-line allowance c′, whereby SF3′+W3′/2=c′. Third sheet 50′ further includes a pair of third-sheet end portions 70′, which extend longitudinally from the central portion ends 56′, respectively, to an outer pair of transverse scored lines 72′. Lines 72′ are equal in length to the predetermined width W3′ and are spaced from the inner pair of transverse scored lines 60′ by an amount E3′ that is at least equal to the article height H, preferably equal to the inner-package height HPI′ plus the score-line allowance c′, whereby the spacing amount E3′ is substantially equal to HPI′=c′+H=2(t1′=t2′)=c′, i.e., E3′+S3′. Third sheet 50′ finally includes a pair of third-sheet end-flap portions 74′, which extend longitudinally from end portions 70′, respectively, to transverse edges 76′ thereof. Edges 76′ are substantially equal in length to the predetermined width W3′ and are spaced from the outer pair of transverse scored lines 72′ by an amount EF3′ that preferably is at least one-tenth and at most one-half the predetermined length L3′ plus the score-line allowance c′, i.e., (L3′/10=c′)≦EF3′≦(L3′/2=c′). In use, as illustrated in FIG. 14, the third-sheet 50′ is positioned to underlie the inner package PI′ so that the second-sheet central portion 20′ at the bottom of package PI′ is longitudinally aligned with and centrally disposed on the third-sheet central portion 52′, after which the pairs of third-sheet end and side portions 70′ and 62′ are to be folded about the inner pairs of transverse and longitudinal scored lines 60′ and 58′ respectively, and thus brought into spaced confronting relation with the folded pairs of first-sheet end portions 42′ and second-sheet side portions 22′ respectively, whereupon the pairs of third-sheet end-flap and side-flap portions 74′ and 66′ are folded about the outer pairs of transverse and longitudinal scored lines 72′ and 64′, respectively, into adjacent confronting relation with the folded pairs of first-sheet and second-sheet flap portions 46′ and 26′. To firmly maintain the inner package PI′ in its aligned, centered position on third-sheet central portion 52′, and thus keep the inner package protectively spaced from the third-sheet end and side portion 70′ and 62′, the second-sheet central portion 20′ of the inner package is secured to the third-sheet central portion 52′ by adhesive means such as the aforementioned hot-melt glue applied to either of their interfacing surfaces.

Figure 15:
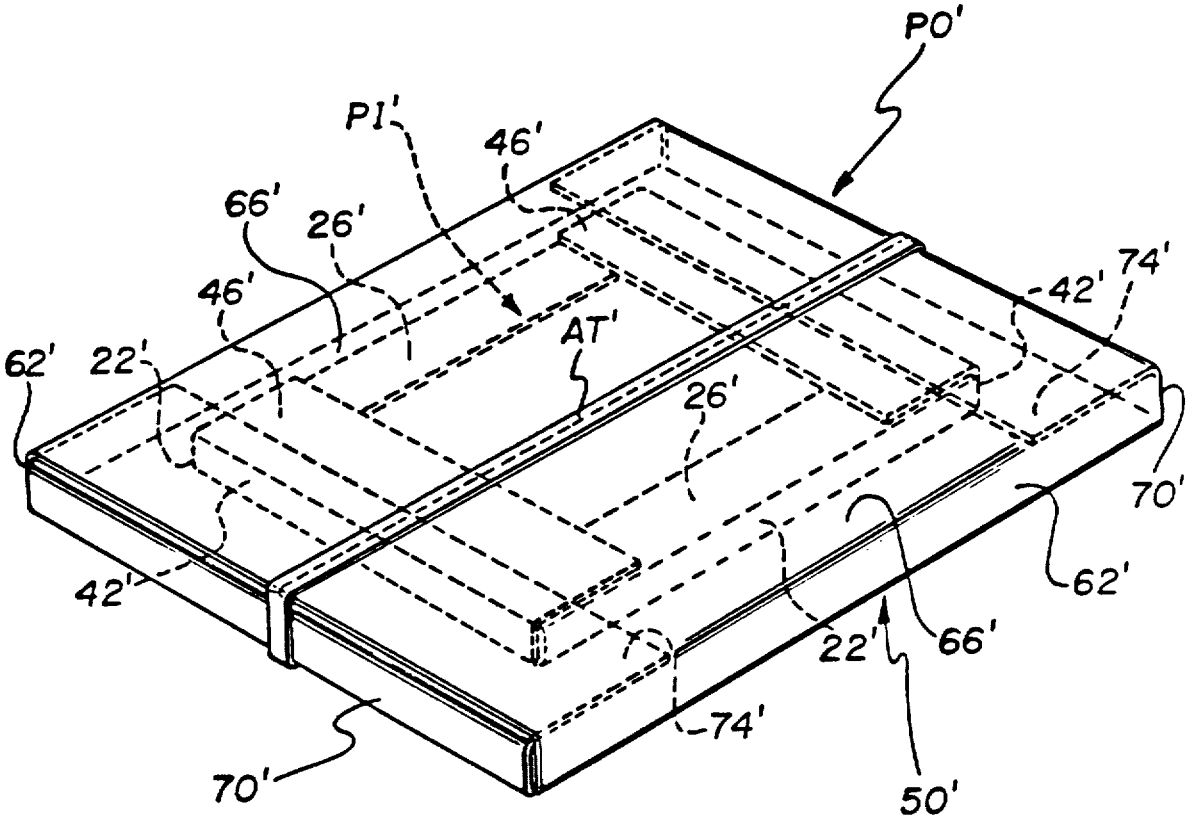
FIG. 15 is a top-perspective view of the inner-package-and-third-sheet combination depicted in FIG. 14, showing symmetrical side and end portions of the third-sheet folded in spaced relation about, and secured in covering relation upon , the inner package to form a protective outer package therearound.

FIG. 15 is similar to FIG. 8 of the first embodiment but portrays, for this embodiment, the final outer package PO′ comprising the glued-together third-sheet 50′ and inner package PI′ of FIG. 14 with third-sheet end and side portions 70′ and 62′ folded, about scored lines 60′ and 58′ respectively, into spaced confronting relation with folded first-sheet end portions 42′ and folded second-sheet side portions 22′ respectively, and with third-sheet end-flap and side-flap portions 74′ and 66′ folded, about scored lines 72′ and 64′ respectively, into contact with folded first-sheet flap portions 46′ and folded third-sheet end-flap portions 74′ respectively, the side-flap portions 66′ being firmly secured in their overlapping contact with end-flap portions 74′ by at least on strip of adhesive tape AT′ joining side-flap portions 66′ to each other and to third-sheet end portions 70′ as shown, thereby maintaining the folded third-sheet end-flap and side-flap portions 74′ and 66′ in their aforementioned adjacent confronting relation with the folded first-sheet and second-sheet flap portions 46′ and 26′ of the inner package.

With respect to each embodiment of this invention set forth above, it can be seen that the overall packaging arrangement provided by the combination of inner and outer packages described ensures a highly protective, impact resistant environment for safely storing, handling, and transporting rectanguloid articles of various sizes, aspect ratios, and degrees of fragility. Moreover, each such arrangement is especially adaptable to customized on-line cutting, scoring, and joining of its constituent paperboard sheets to form su:h inner and outer packages for a succession of randomly varying articles. Standard corrugated paperboard cutting tools and scoring wheels may be utilized to cut and score hopper fed sheets in accordance with the dimensions of ea:h succeeding article to be packaged. Electronic controls may be used to command needed mechanical drives, sheet pushers, and positioners, for selectively and readily positioning the sheets, cutting knives, and scoring wheels in an automated on-line packaging operation.

While the present invention has been described in detail with particular reference to its two embodiments as illustrated herein, it should be understood that further variations and modifications can be effected within the spirit and scope of this invention.

What is claimed is:

1. A package for securely containing a rectanguloid article of given length, width, and height defining opposite sides, opposite ends, and opposite bottom and top surfaces of the article, said package comprising:

a first substantially rectangular sheet of corrugated paperboard having a first-sheet width substantially equal to the article length and a first-sheet length that is greater than the article width plus twice the article height but not greater than twice the article width plus twice the article height, said first-sheet having transversely oriented, longitudinally spaced pairs of parallel inner and outer scored lines thereon defining a first-sheet rectangular central portion substantially conforming to the article bottom surface, a pair of first-sheet rectangular side portions extending respectively from opposite sides of said first-sheet central portion and substantially conforming to the article sides, and a pair of first-sheet flap portions extending respectively from said first-sheet side portions, said first-sheet central portion being adapted to support the article bottom surface thereon, said pairs of first-sheet side and flap portions being folded about said pairs of first-sheet inner and outer scored lines, respectively, into adjacent confronting relation with the article sides and article top surface, respectively, when the article is supported on said first-sheet central portion; a second substantially rectangular sheet of corrugated paperboard having a second-sheet width substantially equal to the article width and a second-sheet length that is greater than the article length plus twice the article height but not greater than twice the article length plus twice the article height, said second-sheet having transversely oriented, longitudinally spaced pairs of parallel inner and outer scored lines thereon defining a second-sheet rectangular central portion substantially conforming to said first-sheet central portion, a pair of second-sheet rectangular end portions extending respectively from opposite ends of said second-sheet central portion and substantially conforming to the article ends, and a pair of second-sheet flap portions extending respectively from said second-sheet end portions, said second sheet underlying said first-sheet transversely thereto so that said second-sheet central portion is in registered supporting relation with said first-sheet central portion, said pairs of second-sheet end and flap portions being folded about said pairs of second-sheet inner and outer scored lines, respectively, into adjacent confronting relation with the article ends and article top surface, respectively, when the article is supported on said first-sheet central portion; and a third-sheet of corrugated paperboard including a third-sheet rectangular central portion having opposite sides and opposite ends of predetermined length and width, respectively, that are greater than the article length and width, respectively, whereby said third-sheet central portion is larger in area than said first-sheet and second-sheet central portions, said third-sheet central portion sides being defined by an inner pair of longitudinal scored lines equal in length to said predetermined length and separated by said predetermined width, said third-sheet central portion ends being defined by an inner pair of transverse scored lines equal in length to said predetermined width and separated by said predetermined length, said third-sheet further including a pair of third-sheet side portions extending laterally from said third-sheet central portion sides, respectively, to an outer pair of longitudinal scored lines equal in length to said predetermined length and spa:ed from said inner pair of longitudinal scored lines by at least the article height, and a pair of third-sheet side-flap portions extending laterally from said third-sheet side portions, respectively, to longitudinal edges thereof substantially equal in length to said predetermined length and spaced from said outer pair of longitudinal scored lines by substantially one-half said predetermined width, said third-sheet further including a pair of third-sheet end portions extending longitudinally from said third-sheet central portion ends, respectively, to an outer pair of transverse scored lines equal in length to said predetermined width and spaced from said inner pair of transverse scored lines by at least the article height, and a pair of third-sheet end-flap portions extending longitudinally from said third-sheet end portions, respectively, to transverse edges thereof substantially equal in length to said predetermined width and spaced from said outer pair of transverse scored lines by at most one-half said predetermined length, said third-sheet underlying said second-sheet so that said second-sheet central portion is longitudinally aligned with and centrally disposed on said third-sheet central portion, said pairs of third-sheet side and end portions being folded about said inner pairs of longitudinal and transverse scored lines, respectively, into spaced confronting relation with said folded pairs of first-sheet side portions and second sheet end portions, respectively, said pairs of third-sheet side-flap and end-flap portions being folded about said outer pairs of longitudinal and transverse scored lines, respectively, into adjacent confronting relation with said folded pairs of first-sheet and second-sheet flap portions.

2. A package as claimed in claim 1 wherein:

one of said pairs of first-sheet flap portions and second-sheet flap portions is folded into contact with the article top surface, when the article is supported on said first-sheet central portion; and the other of said pairs of first-sheet and second-sheet flap portions is folded into contact with said one of said pairs of first- and second-sheet flap portions.

3. A package as claimed in claim 2 wherein:

one of said pairs of third-sheet side-flap and third-sheet end-flap portions is folded into contact with said other of said folded pairs of first- and second-sheet flap portions; and the other of said pairs of third-sheet side-flap and end-flap portions is folded into contact with said one of said pairs of third-sheet side- and end-flap portions.

4. A package as claimed in claim 3 wherein:

each of said first-sheet flap portions extends from one of said first-sheet side portions by an amount between one-tenth and one-half the article width; and each of said second-sheet flap portions extends from one of said second-sheet end portions by an amount between one-tenth and one-half the article length.

5. A package as claimed in claim 4 wherein:

each of said third-sheet side-flap portion longitudinal edges is spaced from one of said outer longitudinal scored lines by substantially one-half said predetermined width; and each of said third-sheet end-flap portion transverse edges is spaced from one of said outer transverse scored lines by an amount between one-tenth and one-half said predetermined length.

6. A package as claimed in claim 5 wherein:

said third-sheet central portion predetermined length is at least five percent greater than the article length; and said third-sheet central portion predetermined width is at least five percent greater than the article width.

7. A package as claimed in claim 6 further comprising:

first means for maintaining said second-sheet central portion in said registered supporting relation with said first-sheet central portion;

second means for maintaining said folded pairs of first-sheet and second-sheet flap portions in said adjacent confronting relation with the article top surface, when the article is supported on said first-sheet central portion;

third means for maintaining said second-sheet central portion longitudinally aligned with and centrally disposed on said third-sheet central portion; and fourth means for maintaining said folded pairs of third-sheet side flap and end-flap portions in said adjacent confronting relation with said folded pairs of first-sheet and second-sheet flap portions.

8. A package as claimed in claim 7 wherein:

said first maintaining means includes adhesive material disposed between said first-sheet and second-sheet central portions;

said second maintaining means includes adhesive material disposed between said folded pair of first-sheet flap portions and said folded pair of second-sheet flap portions;

said third maintaining means includes adhesive material disposed between said second-sheet and third-sheet central portions; and said fourth maintaining means includes adhesive tape joining said folded pair of third-sheet side-flap portions to each other and to said folded pair of third-sheet end portions.

9. A package as claimed in claim 2 wherein:

said one of said pairs of first-sheet and second-sheet flap portions is said pair of second-sheet flap portions; and said other of said pairs of first-sheet and second-sheet flap portions is said pair of first-sheet flap portions.

10. A package as claimed in claim 3 wherein:

said one of said pairs of third-sheet side-flap and end-flap portions is said pair of third-sheet end-flap portions; and said other of said pairs of third-sheet side-flap and end-flap portions is said pair of third-sheet side-flap portions.

11. A package for securely containing a rectanguloid article of given length, width, and height defining opposite sides, opposite ends, and opposite bottom and top surfaces of the article, said package comprising:

a first substantially rectangular sheet of corrugated paperboard having a first-sheet width substantially equal to the article width and a first-sheet length that is greater than the article length plus twice the article height but not greater than twice the article length plus twice the article height, said first-sheet having transversely oriented, longitudinally spaced pairs of parallel inner and outer scored lines thereon defining a first-sheet rectangular central portion substantially conforming to the article bottom surface, a pair of first-sheet rectangular end portions extending respectively from opposite ends of said first-sheet central portion and substantially conforming to the article ends, and a pair of first-sheet flap portions extending respectively from said first-sheet end portions, said first-sheet central portion being adapted to support the article bottom surface thereon, said pairs of first-sheet end and flap portions being folded about said pairs of first-sheet inner and outer scored lines, respectively, into adjacent confronting relation with the article ends and article top surface, respectively, when the article is supported on said first-sheet central portion;

a second substantially rectangular sheet of corrugated paperboard having a second-sheet width substantially equal to the article length and a second-sheet length that is greater than the article width plus twice the article height but not greater than twice the article width plus twice the article height, said second-sheet having transversely oriented, longitudinally spaced pairs of parallel inner and outer scored lines thereon defining a second-sheet rectangular central portion substantially conforming to said first-sheet central portion, a pair of second-sheet rectangular side portions extending respectively from opposite sides of said second-sheet central portion and substantially conforming to the article sides, and a pair of second-sheet flap portions extending respectively from said second-sheet side portions, said second-sheet underlying said first-sheet transversely thereto so that said second-sheet central portion is in registered supporting relation with said first-sheet central portion, said pairs of second-sheet side and flap portions being folded about said pairs of second-sheet inner and outer scored lines, respectively, into adjacent confronting relation with the article sides and article top surface, respectively, when the article is supported on said first-sheet central portion; and a third-sheet of corrugated paperboard including a third-sheet rectangular central portion having opposite sides and opposite ends of predetermined length and width, respectively, that are greater than the article length and width, respectively, whereby said third-sheet central portion is larger in area than said first-sheet and second-sheet central portions, said third-sheet central portion sides being defined by an inner pair of longitudinal scored lines equal in length to said predetermined length and separated by said predetermined width, said third-sheet central portion ends being defined by an inner pair of transverse scored lines equal in length to said predetermined width and separated by said predetermined length, said third-sheet further including a pair of third-sheet side portions extending laterally from said third-sheet central portion sides, respectively, to an outer pair of longitudinal scored lines equal in length to said predetermined length and spaced from said inner pair of longitudinal scored lines by at least the article height, and a pair of third-sheet side-flap portions extending laterally from said third-sheet side portions, respectively, to longitudinal edges thereof substantially equal in length to said predetermined length and spaced form said outer pair of longitudinal scored lines by substantially one-half said predetermined width, said third-sheet further including a pair of third-sheet end portions extending longitudinally from said third-sheet central portion ends, respectively, to an outer pair of transverse scored lines equal in length to said predetermined width and spaced from said inner pair of transverse scored lines by at least the article height, and a pair of third-sheet end-flap portions extending longitudinally from said third-sheet end portions, respectively, to transverse edges thereof substantially equal in length to said predetermined width and spaced from said outer pair of transverse scored lines by at most one-half said predetermined length, said third-sheet underlying said second-sheet so that said second-sheet central portion is longitudinally aligned with and centrally disposed on said third-sheet central portion, said pairs of third-sheet end and side portions being folded about said inner pairs of transverse and longitudinal scored lines, respectively, into spaced confronting relation with said folded pairs of first-sheet end portions and second-sheet side portions, respectively, said pairs of third-sheet end-flap and side-flap portions being folded about said outer pairs of transverse and longitudinal scored lines, respectively, into adjacent confronting relation with said folded pairs of first-sheet and second-sheet flap portions.

12. A package as claimed in claim 11 wherein:

one of said pairs of first-sheet flap portions and second-sheet flap portions is folded into contact with the article top surface, when the article is supported on said first-sheet central portion; and the other of said pairs of first-sheet and second-sheet flap portions is folded into contact with said one of said pairs of first- and second-sheet flap portions.

13. A package as claimed in claim 12 wherein:

said one of said pairs of first-sheet and second-sheet flap portions is said pair of second-sheet flap portions; and said other of said pairs of first-sheet and second-sheet flap portions is said pair of first-sheet flap portions.

14. A package as claimed in claim 12 wherein:

one of said pairs of third-sheet side-flap and third-sheet end-flap portions is folded into contact with said other of said folded pairs of first- and second-sheet flap portions; and the other of said pairs of third-sheet side-flap and end-flap portions is folded into contact with said one of said pairs of third-sheet side- and end-flap portions.

15. A package as claimed in claim 14 wherein:

said one of said pairs of third-sheet side-flap and end-flap portions is said pair of third-sheet end-flap portions; and said other of said of third-sheet side-flap and end-flap portions is said pair of third-sheet side-flap portions.

16. A package as claimed in claim 14 wherein:

each of said first-sheet flap portions extends from one of said first-sheet end portions by an amount between one-tenth and one-half the article length; and each of said second-sheet flap portions extends from one of said second-sheet side portions by an amount between one-tenth and one-half the article width.

17. A package as claimed in claim 16 wherein:

each of said third-sheet side-flap portion longitudinal edges is spaced from one of said outer longitudinal scored lines by substantially one-half said predetermined width; and each of said third-sheet end-flap portion transverse edges is spaced from one of said outer transverse scored lines by an amount between one-tenth and one-half said predetermined length.

18. A package as claimed in claim 17 wherein:

said third-sheet central portion predetermined length is at least five percent greater than the article length; and said third-sheet central portion predetermined width is at least five percent greater than the article width.

19. A package as claimed in claim 18 further comprising:

first means for maintaining said second-sheet central portion in said registered supporting relation with said first-sheet central portion;

second means for maintaining said folded pairs of first-sheet and second-sheet flap portions in said adjacent confronting relation with the article top surface, when the article is supported on said first-sheet central portion.

third means for maintaining said second-sheet central portion longitudinally aligned with and centrally disposed on said third-sheet central portion; and fourth means for maintaining said folded pairs of third-sheet end-flap and side-flap portions in said adjacent confronting relation with said folded pairs of first-sheet and second-sheet flap portions.

20. A package as claimed in claim 19 wherein:

said first maintaining means includes adhesive material disposed between said first-sheet and second-sheet central portions;

said second maintaining means includes adhesive material disposed between said folded pair of first-sheet flap portions and said folded pair of second-sheet flap portions;

said third maintaining means includes adhesive material disposed between said second-sheet and third-sheet central portions; and said fourth maintaining means includes adhesive tape joining said folded pair of third-sheet side-flap portions to each other and to said folded pair of third-sheet end portions.

* * * * *

UNITED STATES PATENT AND TRADEMARK OFFICE

CERTIFICATE OF CORRECTION

PATENT NO. : 4,974,770

DATED : December 4, 1990

INVENTOR(S) : Robert C. Wright

It is certified that error appears in the above-identified patent and that said Letters Patent is hereby corrected as shown below:

Sheets 1-5 of the drawings should be deleted to be replaced with Sheets 1-9 of drawings, consisting of Figs. 1-15, as shown on the attached pages.

Signed and Sealed this

Fifth Day of May, 1992

*Attest:*

DOUGLAS B. COMER

*Attesting Officer*

*Acting Commissioner of Patents and Trademarks*